US010635032B2

(12) United States Patent
Imaizumi et al.

(10) Patent No.: US 10,635,032 B2
(45) Date of Patent: Apr. 28, 2020

(54) IMAGE FORMING APPARATUS

(71) Applicant: CANON KABUSHIKI KAISHA, Tokyo (JP)

(72) Inventors: Toru Imaizumi, Kawasaki (JP); Sho Taguchi, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/266,803

(22) Filed: Feb. 4, 2019

(65) Prior Publication Data

US 2019/0243292 A1 Aug. 8, 2019

(30) Foreign Application Priority Data

Feb. 6, 2018 (JP) ..... 2018-019631

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

| | | | | |
|---|---|---|---|---|
| 9,075,356 | B2 | 7/2015 | Ooyanagi | |
| 9,436,147 | B2 | 9/2016 | Yamazaki | |
| 2018/0067427 | A1* | 3/2018 | Obayashi | G03G 15/2039 |

FOREIGN PATENT DOCUMENTS

| | | | | |
|---|---|---|---|---|
| JP | 2008-268784 | A | | 11/2008 |
| JP | 2012073441 | A | * | 4/2012 |
| JP | 2014-074894 | A | | 4/2014 |
| JP | 2015-145969 | A | | 8/2015 |
| JP | 2016-004231 | A | | 1/2016 |
| JP | 2016136225 | A | * | 7/2016 |

* cited by examiner

*Primary Examiner* — Susan S Lee
(74) *Attorney, Agent, or Firm* — Venable LLP

(57) ABSTRACT

Image data of an image formed on a recording material includes a plurality of picture elements. A predetermined number of picture elements which is a portion of the image data are converted as one region to thereby convert the image data to conversion data including a plurality of regions. A value related to a print ratio in each of the regions of the conversion data is analyzed to acquire a value related to connection indicating how continuously regions in which the value related to the print ratio exceeds a threshold are adjacent to each other. Energization of the heat generating element is controlled on the basis of the temperature detected by the temperature detection portion and a control target temperature calculated from the value related to the connection.

16 Claims, 16 Drawing Sheets

24 PIXELS

| | | | | |
|---|---|---|---|---|
| 0 | 0 | 0 | 0 | 0 |
| 0 | 64 | 80 | 16 | 0 |
| 0 | 80 | 100 | 36 | 4 |
| 0 | 80 | 100 | 100 | 20 |
| 0 | 16 | 20 | 20 | 4 |

| | | | | |
|---|---|---|---|---|
| 0 | 0 | 0 | 0 | 0 |
| 0 | 1 | 1 | 0 | 0 |
| 0 | 1 | 1 | 0 | 0 |
| 0 | 1 | 1 | 1 | 0 |
| 0 | 0 | 0 | 0 | 0 |

| | | | | |
|---|---|---|---|---|
| 0 | 0 | 0 | 0 | 0 |
| 0 | 3 | 3 | 0 | 0 |
| 0 | 3 | 3 | 0 | 0 |
| 0 | 3 | 3 | 1 | 0 |
| 0 | 0 | 0 | 0 | 0 |

| | | | | |
|---|---|---|---|---|
| 0 | 0 | 0 | 0 | 0 |
| 0 | 2 | 2 | 0 | 0 |
| 0 | 2 | 2 | 0 | 0 |
| 0 | 3 | 3 | 3 | 0 |
| 0 | 0 | 0 | 0 | 0 |

| | | | | |
|---|---|---|---|---|
| $T_{0_0}$ | $T_{0_0}$ | $T_{0_0}$ | $T_{0_0}$ | $T_{0_0}$ |
| $T_{0_0}$ | $T_{3_2}$ | $T_{3_2}$ | $T_{0_0}$ | $T_{0_0}$ |
| $T_{0_0}$ | $T_{3_2}$ | $T_{3_2}$ | $T_{0_0}$ | $T_{0_0}$ |
| $T_{0_0}$ | $T_{3_3}$ | $T_{3_3}$ | $T_{1_3}$ | $T_{0_0}$ |
| $T_{0_0}$ | $T_{0_0}$ | $T_{0_0}$ | $T_{0_0}$ | $T_{0_0}$ |

24 PIXELS

| | | | | | |
|---|---|---|---|---|---|
| 0 | 0 | 0 | 0 | 0 | 0 |
| 0 | 16 | 4 | 56 | 56 | |
| 0 | 20 | 9 | 1 | 0 | |
| 0 | 20 | 25 | 5 | 0 | |
| 0 | 4 | 5 | 1 | 0 | |

| | | | | | |
|---|---|---|---|---|---|
| 0 | 0 | 0 | 0 | 0 | 0 |
| 0 | 0.5 | 0 | 1 | 1 | |
| 0 | 0.5 | 0 | 0 | 0 | |
| 0 | 0.5 | 0.5 | 0 | 0 | |
| 0 | 0 | 0 | 0 | 0 | |

| | | | | | |
|---|---|---|---|---|---|
| 0 | 0 | 0 | 0 | 0 | 0 |
| 0 | 3 | 0 | 1 | 1 | |
| 0 | 3 | 0 | 0 | 0 | |
| 0 | 3 | 1 | 0 | 0 | |
| 0 | 0 | 0 | 0 | 0 | |

| | | | | | |
|---|---|---|---|---|---|
| 0 | 0 | 0 | 0 | 0 | 0 |
| 0 | 1 | 0 | 2 | 2 | |
| 0 | 1 | 0 | 0 | 0 | |
| 0 | 2 | 2 | 0 | 0 | |
| 0 | 0 | 0 | 0 | 0 | |

| | | | | | |
|---|---|---|---|---|---|
| $T_{0,0}$ | $T_{0,0}$ | $T_{0,0}$ | $T_{0,0}$ | $T_{0,0}$ | $T_{0,0}$ |
| $T_{0,0}$ | $T2_{3,1}$ | $T_{0,0}$ | $T_{1,2}$ | $T_{1,2}$ | |
| $T_{0,0}$ | $T2_{3,1}$ | $T_{0,0}$ | $T_{0,0}$ | $T_{0,0}$ | |
| $T_{0,0}$ | $T2_{3,2}$ | $T2_{1,2}$ | $T_{0,0}$ | $T_{0,0}$ | |
| $T_{0,0}$ | $T_{0,0}$ | $T_{0,0}$ | $T_{0,0}$ | $T_{0,0}$ | |

IMAGE FORMING APPARATUS

BACKGROUND OF THE INVENTION

Field of the Invention

The present invention relates to an image heating apparatus such as a fixing unit mounted on an image forming apparatus such as a copying machine or a printer which uses an electrophotographic system or an electrostatic recording system or a gloss providing apparatus that heats a fixed toner image on a recording material again to improve a gloss level of the toner image. The present invention also relates to an image forming apparatus including the image heating apparatus.

Description of the Related Art

A film-heating-type apparatus which is excellent in saving energy and can start quickly is known as a fixing apparatus mounted on a conventional image forming apparatus such as a laser printer which uses an electrophotographic system. A technology of controlling a fixing temperature of a fixing unit according to a toner laid-on level calculated from image data to further save energy is known. Japanese Patent Application Publication No. 2016-4231 discloses a method of performing an image thinning process on input image data, determining a largest toner amount of dots in a page (hereinafter referred to as a laid-on level), and increasing a fixing temperature of a fixing unit when fixing an image having a large laid-on level as compared to when fixing an image having a small laid-on level. Moreover, Japanese Patent Application Publication No. 2008-268784 discloses a method of calculating a print ratio in a plurality of regions and performing appropriate temperature control according to the calculation result.

SUMMARY OF THE INVENTION

However, the configuration disclosed in the related art is not always accurately applied to a control temperature necessary for fixing. For example, when solid black images of a certain shape are printed, the necessary control temperature is different depending on a method of connecting the images. However, there are cases in which a difference in fixing performance resulting from the size of connecting the images is not expressed appropriately. In the configuration disclosed in Japanese Patent Application Publication No. 2016-4231, the same fixing temperature control is performed if the largest toner laid-on levels are the same. Therefore, it is not possible to cope with a case in which the toner laid-on level is constant and an image shapes are different. In the configuration disclosed in Japanese Patent Application Publication No. 2008-268784, the same fixing temperature control is performed if the print ratios in respective regions are the same. Therefore, it is not possible to cope with a case in which a printing area is constant and a method of connecting images. Therefore, if a control temperature is set so that an image having a shape or an arrangement with the worst fixing performance is fixed sufficiently, the set control temperature increases and the power consumption increases excessively for images having the other shapes or arrangements. Therefore, since a high control temperature is set for an image although the image can be fixed using a low control temperature, energy is consumed unnecessarily.

An object of the present invention is to provide an image forming apparatus which provides satisfactory fixing performance regardless of an image pattern and suppresses unnecessary power consumption to provide excellent energy saving properties.

In order to attain the object, an image forming apparatus of the present invention includes:

an image heating portion including a heater including a substrate and a heat generating element provided on the substrate, the image heating portion heating an image formed on a recording material on the basis of image data using the heat of the heater;

a temperature detection portion that detects a temperature of a heating region of the recording material heated by the heater;

an energization control portion that controls electric power to be supplied to the heat generating element;

an image conversion portion that converts the image data to conversion data including a plurality of regions by converting a predetermined number of picture elements which is a portion of the image data as one of the plurality of regions; and a continuity acquiring portion that analyzes a value related to a print ratio in each of the regions of the conversion data and acquires a value related to connection indicating how many continuous regions in which the value related to the print ratio exceeds a threshold are adjacent to each other; and wherein the energization control portion controls energization of the heat generating element on the basis of the temperature detected by the temperature detection portion and a control target temperature calculated from the value related to the connection.

According to the present invention, it is possible to provide an image forming apparatus which provides satisfactory fixing performance regardless of an image pattern and suppresses unnecessary power consumption to provide excellent energy saving properties.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Image Forming Apparatus

Figure 1:
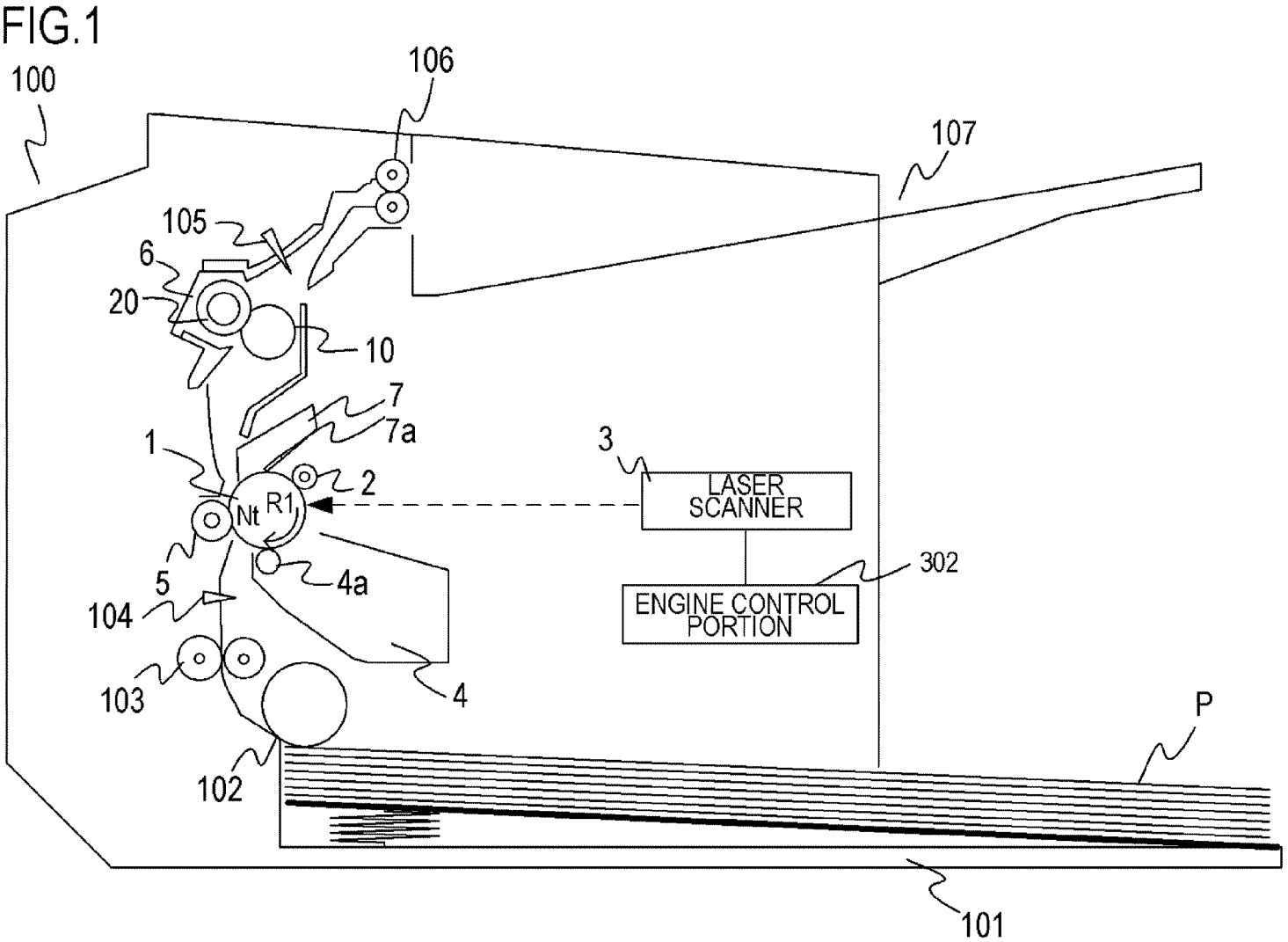
FIG. 1 is a block diagram (a cross-sectional view) of an image forming apparatus according to an invention of Embodiment 1.

FIG. 1 illustrates an image forming apparatus according to an embodiment of the present invention (that is, an image forming apparatus including a heating and fixing apparatus and an image analysis unit according to an embodiment of the present invention). FIG. 1 is a longitudinal cross-sectional view illustrating a schematic configuration of a monochrome laser printer as an example of an image forming apparatus according to an embodiment of the present invention. First, a configuration of a laser printer will be described in detail with reference to FIG. 1. The present invention can be applied to various image forming apparatuses which use a heating and fixing apparatus, such as a printer (for example, a laser printer and a LED printer) or a digital copying machine.

An image forming apparatus 100 illustrated in FIG. 1 includes a drum-type electrophotographic photosensitive member 1 (hereinafter referred to as a "photosensitive drum 1") as an image bearing member. The photosensitive drum 1 includes a cylindrical drum substrate formed of an aluminum alloy or nickel and a photosensitive material such as an organic photoconductor (OPC), amorphous selenium, amorphous silicon, formed on the drum substrate. The photosensitive drum 1 is driven by a driving unit (not illustrated) so as to rotate at a predetermined process speed (circumferential speed) in the direction indicated by arrow R1.

The surface of the photosensitive drum 1 is uniformly charged to a predetermined polarity and a predetermined potential by a charging roller 2. A laser beam from a laser scanner 3 is radiated to the photosensitive drum 1 after the charging whereby an electrostatic latent image is formed on the surface of the photosensitive drum 1. The laser scanner 3 performs scanning exposure with ON/OFF control according to image information to remove charges in an exposed portion to form an electrostatic latent image on the surface of the photosensitive drum 1. The electrostatic latent image is developed and visualized by a developing apparatus 4. The electrostatic latent image is developed as a toner image with toner attached thereto with the aid of a developing roller 4*a*. The toner is an approximately spherical particle having a grain size of 4 μm to 10 μm containing a binder resin, a wax as a release agent, a coloring material, and the like. A plurality of layers of toner particles is stacked on a solid black printing portion.

A toner image on the photosensitive drum 1 is transferred to a surface of a recording material P. The recording material P is accommodated in a sheet feeding tray 101. The recording material P is fed one by one by a sheet feeding roller 102 and is supplied to a transfer nip portion Nt between the photosensitive drum 1 and a transfer roller 5 by a transport roller 103 or the like. In this case, a leading end of the recording material P is detected by a top sensor 104, and a timing at which the leading end of the recording material P arrives at the transfer nip portion Nt is determined on the basis of the position of the top sensor 104, the position of the transfer nip portion Nt, and a transport speed of the recording material P. The toner image on the photosensitive drum 1 is transferred to the recording material P which has been fed and transported at a predetermined timing as described above when a transfer bias is applied to the transfer roller 5.

The recording material P having the toner image transferred thereto is transported to a heating and fixing apparatus 6 as an image heating portion and is heated and pressurized while being pinched and transported at a fixing nip portion between a heating member 10 and a pressure roller 20 of the heating and fixing apparatus 6 whereby the toner image is fixed to the surface of the recording material P. After that, the recording material P having the toner image fixed thereto is discharged to a sheet discharge tray 107 formed on an upper surface of the image forming apparatus 100 by a sheet discharge roller 106. In the meantime, a sheet discharge sensor 105 detects the timings at which the leading end and the trailing end of the recording material P pass through the sheet discharge sensor 105 to monitor whether a jam or the like has occurred.

On the other hand, the toner which remains on the photosensitive drum 1 without being transferred to the recording material P after the toner image was transferred is removed by a cleaning blade 7*a* of a cleaning apparatus 7 and is provided for subsequent image forming operations.

By repeatedly performing the above-described operations, images can be formed sequentially. The image forming apparatus of the present embodiment is an example of an apparatus of which the resolution is 600 dpi, the printing speed is 30 pages per minute (LTR vertical feed: process speed of approximately 168 mm/s), and the lifespan is 100,000 pages.

Printer Control Device

Figure 2:
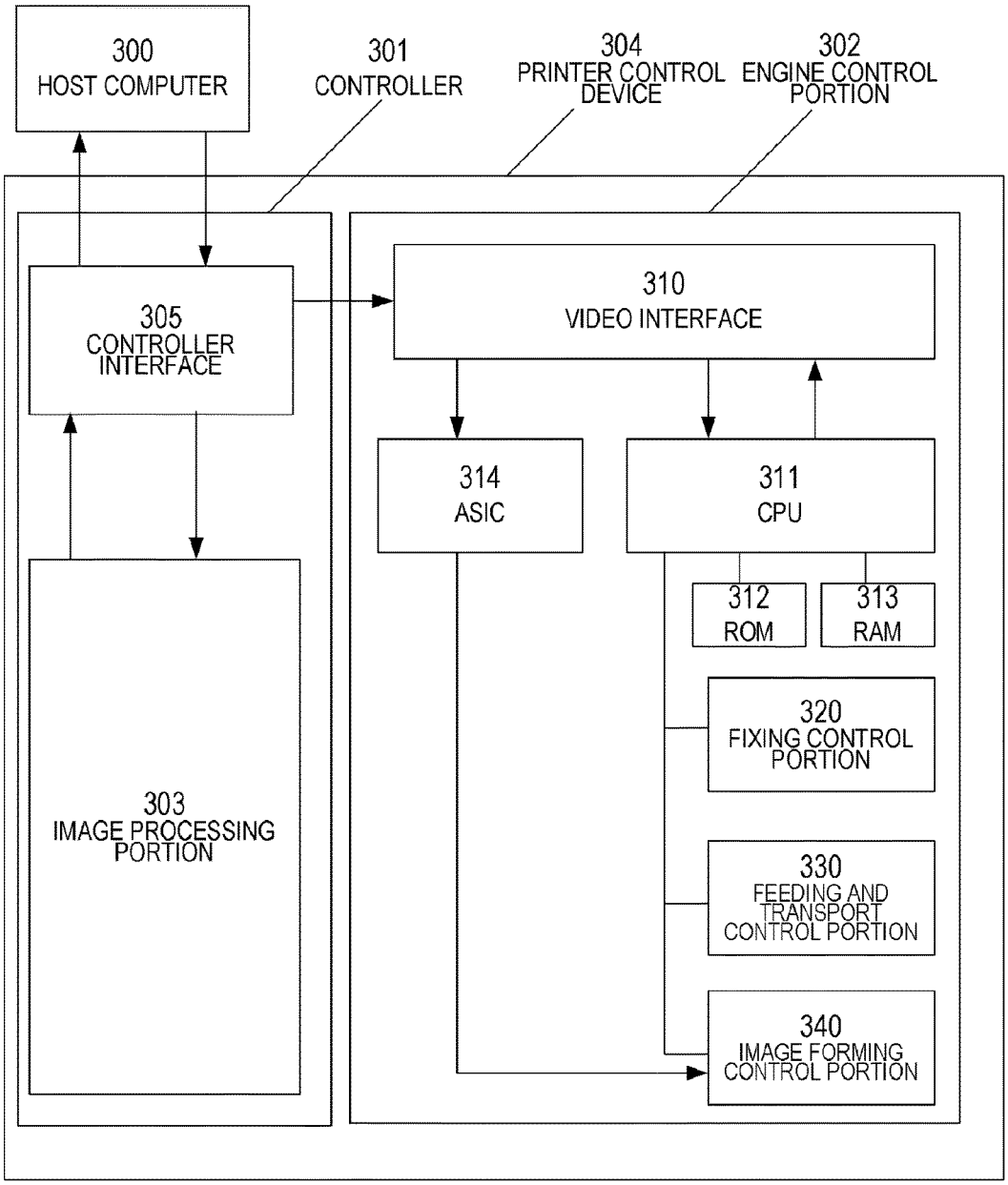
FIG. 2 is a block diagram illustrating a system configuration of a printer control device according to an invention of Embodiment 1.

A printer control device 304 according to the present embodiment will be described with reference to FIG. 2. FIG. 2 illustrates a configuration of a printer system according to the present embodiment. The printer control device 304 is connected to and communicates with a host computer 300 using a controller interface 305. The printer control device 304 is roughly divided into a controller portion 301 and an engine control portion 302. The controller portion 301 converts character codes into bitmap images and converts grayscale images into halftone images with the aid of an image processing portion 303 on the basis of information received from the host computer 300 and transmits image information to a video interface 310 of the engine control portion 302. The image information includes information for controlling on/off timings of the laser scanner 3, a print mode for controlling a process condition such as a control temperature or a transfer bias, and image size information.

The on/off timing information of the laser scanner 3 is transmitted from the controller portion 301 to an application specific integrated circuit (ASIC) 314. The ASIC 314 controls a portion (such as the laser scanner 3) of the image forming portion that the image forming control portion 340 controls.

On the other hand, the information such as a print mode and the image size is transmitted to a CPU (central processing unit) 311. The CPU 311 controls the temperature of the heating and fixing apparatus 6 with the aid of a fixing control portion 320, controls an operation interval of the sheet feeding roller 102 with the aid of a feeding and transport control portion 330, and controls the process speed and developing, charging, and transferring operations with the aid of an image forming control portion 340. In this control operations, the CPU 311 stores information in a RAM 313, uses programs stored in the RAM 313 or a ROM 312, and refers to the information stored in the RAM 313 or the ROM 312 as necessary.

Furthermore, the controller portion 301 transmits a print command, a cancel instruction, and the like to the engine control portion 302 according to an instruction that a user has issued on a host computer and controls an operation of starting and stopping a print operation.

Fixing Apparatus

The film-heating-type heating and fixing apparatus 6 according to the present embodiment will be described with reference to FIG. 3. The heating and fixing apparatus 6 includes the film unit 10 as a heating apparatus and the pressure roller 20. The film unit 10 includes a fixing film 13 which is a cylindrical rotating member as a fixing member, a heating heater 11 which is a heating member, and a heater holder 12 which is a heater holding member. The heating heater 11 of which the details will be described later is a heating element which uses the heat generated by energization of a heat generating element provided on a substrate. Moreover, the pressure roller 20 is provided as an elastic rotating member as a pressurizing member that faces the film unit 10.

The heating and fixing apparatus 6 configured in this manner causes the recording material P having the toner image t formed thereon to be pinched and transported at a pressure nip portion (the fixing nip portion) formed by the heating heater 11 and the pressure roller 20 with the aid of the fixing film 13. In this way, the toner image t is fixed to the recording material P.

Figure 3:
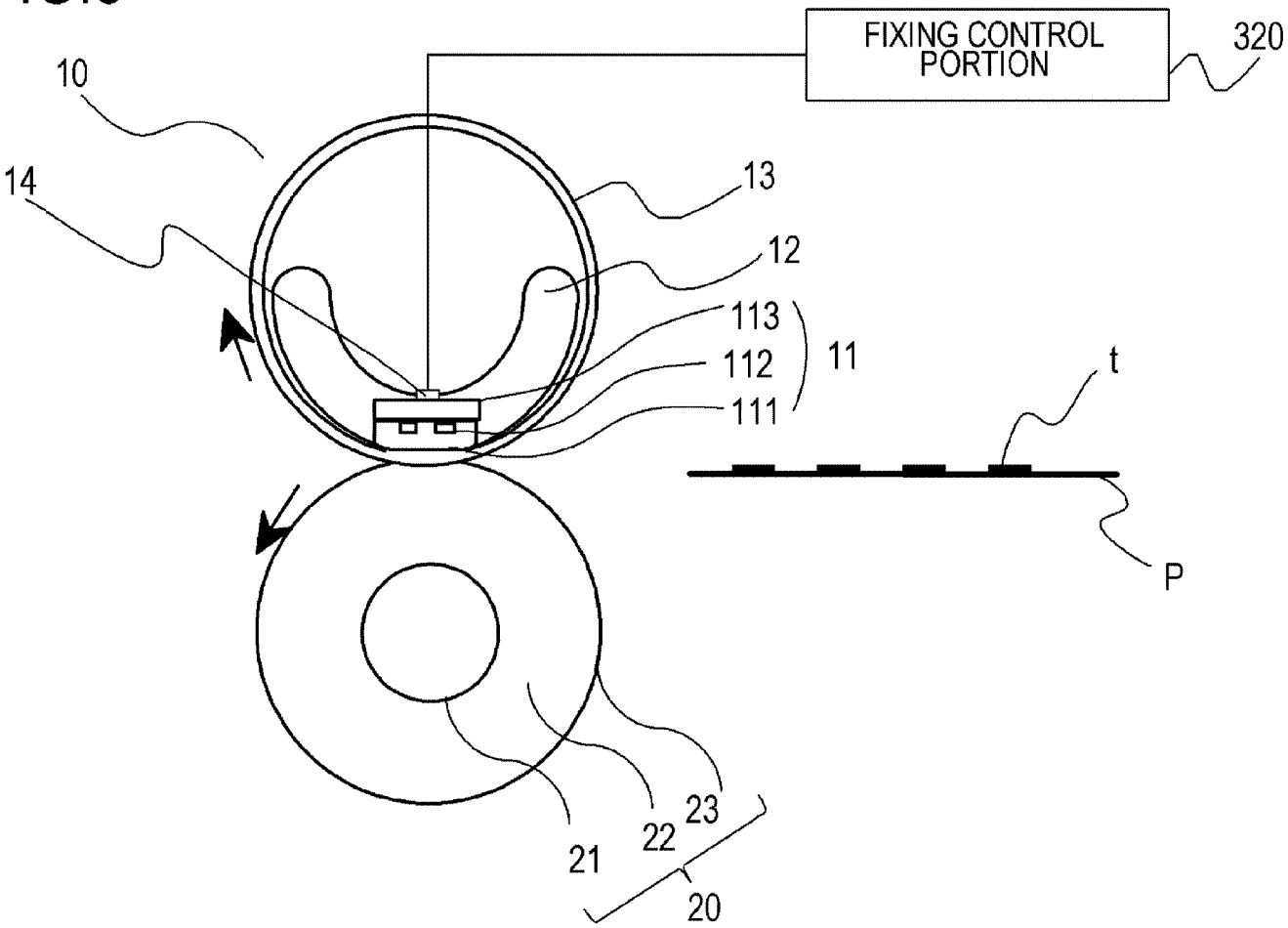
FIG. 3 is a block diagram (a cross-sectional view) of a heating and fixing apparatus according to an invention of Embodiment 1.

In FIG. 3, a thermistor 14 as a temperature detection member or a temperature detection element that detects the temperature of the heating heater 11 (a region heated by the heating heater 11) is disposed in contact with a surface of the heating heater 11 on the opposite side of a surface sliding on an inner surface of the fixing film 13. The fixing control portion 320 (the engine control portion 302) controls the electric power supplied to the heating heater 11 on the basis of the temperature detected by the thermistor 14 so that the heating heater 11 is at a desired temperature.

The heating heater 11 has a resistor heat generating layer 112 on a substrate 113. The resistor heat generating layer 112 is covered with an overcoat glass 111 to improve insulation and abrasion resistance properties of the resistor heat generating layer 112, and the overcoat glass 111 is configured to make contact with an inner circumferential surface of the fixing film 13. A small amount of a lubricating agent such as a heat-resistant grease is applied to the surface of the heating heater 11. In this way, the fixing film 13 can rotate smoothly. The substrate 113 of the heating heater 11 of the present embodiment is formed of alumina. The substrate 113 has a width of 6.0 mm, a length of 260.0 mm, and a thickness of 1.00 mm, and the coefficient of thermal expansion thereof is $7.6\times10^{-6}$/° C. The resistor heat generating layer 112 of the present embodiment is formed of a silver-palladium alloy, a total resistance thereof is 20Ω, and a temperature dependence of resistivity is 700 ppm/° C.

The fixing film 13 is a composite-layer film. That is, the fixing film 13 has a substrate obtained by kneading a thin metallic element tube of SUS or the like or a heat-resistant resin of polyimide or the like with a heat conduction filler of graphite or the like and forming a resulting member into a cylindrical form. The surface of the substrate is coated or tube-covered directly with a releasing layer of PFA, PTFE, FEP, or the like or with a primer layer disposed therebetween. The fixing film 13 used in the present embodiment is a polyimide substrate coated with PFA. A total film thickness is 70 μm and an outer circumferential length is 57 mm.

The pressure roller 20 illustrated in FIG. 3 includes a core 21 formed of iron or the like, an elastic layer 22 formed by foaming an insulating silicon rubber or a heat-resistant rubber such as a fluororubber on the core 21, and a RTV silicon rubber which has been subjected to a primer treatment and has an adhesion property, formed on the elastic layer 22 as an adhesive layer. Moreover, a tube obtained by dispersing a conductive agent such as carbon into PFA, PTFE, FEP, or the like is covered or coated to form a releasing layer 23 on the pressure roller 20. In the present embodiment, a pressure roller of which the outer diameter is 20 mm and the hardness is 48° (Asker-C Hardness, when a load of 600 g was applied) is used.

The pressure roller 20 is pressed with a force of 15 Kg·f by a pressure unit (not illustrated) from both ends in a longitudinal direction so that a nip portion necessary for heating and fixing can be formed. The pressure roller 20 is rotated and driven in the direction (the counter-clockwise direction) indicated by an arrow in FIG. 3 by a driving force (not illustrated) applied from an end in the longitudinal direction with the core 21 disposed therebetween. In this way, the fixing film 13 rotates in the direction (the clockwise direction) indicated by an arrow in FIG. 3 around a heater holder 12.

The heater holder 12 holds the heating heater 11 and is formed of a liquid crystal polymer, a phenol resin, PPS, PEEK, or the like. The fixing film 13 is loosely fitted to the heater holder 12 so as to freely rotate. The heater holder 12 used in the present embodiment is formed of a liquid crystal polymer having a heat resistance of 260° C. and the coefficient of thermal expansion of $6.4\times10^{-5}$/° C.

Fixing Temperature Control Portion

The fixing control portion 320 as an energization control portion has a temperature control program and controls the temperature of the heating heater 11 to be a predetermined control temperature (a control target temperature) on the basis of the detection temperature detected by the thermistor 14 as a temperature detection element of a temperature detection portion. PID control including a proportional term, an integral term, and a differential term is preferably used as a control method. A heater energization period within a cycle is determined by the PID control, and a heater energization period control circuit (not illustrated) is driven to determine a heater output power. In the present embodiment, the heater output power is updated at the interval of the control cycle of 100 msec.

The control temperature is set on the basis of the information from the image processing portion 303 to be described later. The fixing control portion 320 may correct and set the control temperature by various corrections performed conventionally on the basis of the degree of warming of the fixing apparatus, the environmental temperature and humidity, a print mode, a recording material type, or the like in addition to the information from the image processing portion 303 to be described later in the present embodiment.

Image Analysis Portion

Figure 4:
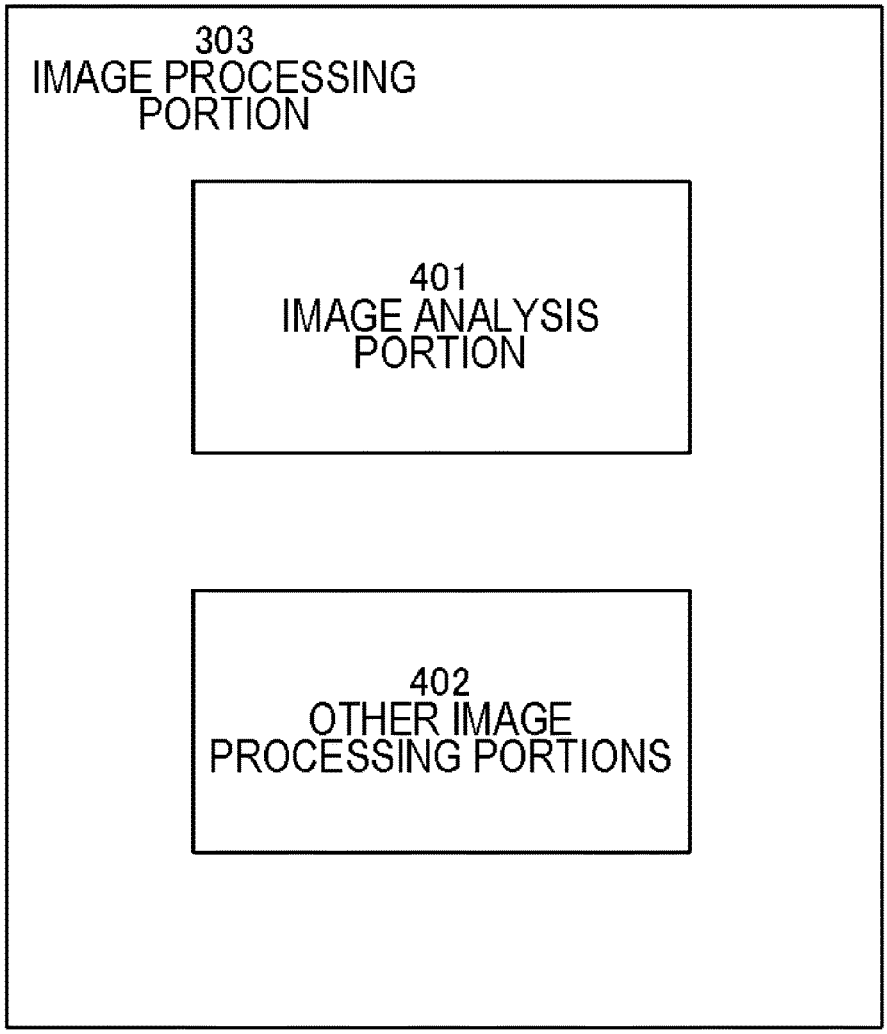
FIG. 4 is a functional block diagram of an image processing portion 303 according to an invention of Embodiment 1.

FIG. 4 illustrates the functional configuration portions of the image processing portion 303. The image processing portion 303 includes an image analysis portion (an image conversion portion) 401 as an image analysis portion and other image processing portions 402. As will be described later, the image analysis portion 401 also functions as a continuity acquiring portion and a control temperature setting portion and calculates a control temperature necessary for an image to be printed or a fixing temperature correlation value correlated with the necessary control temperature. The other image processing portions 402 convert character codes into images and convert grayscale images into halftone images to convert images to bitmap images.

In the image forming apparatus of the present embodiment, the other image processing portions 402 perform processing with a resolution of 600 dpi. The calculation processing procedure of the image analysis portion 401 of the present embodiment is performed on the image data obtained when the processing of the other image processing portions 402 ends. However, an image processing procedure is not limited thereto and may be selected appropriately.

Characteristics of Image Analysis

Figure 5:
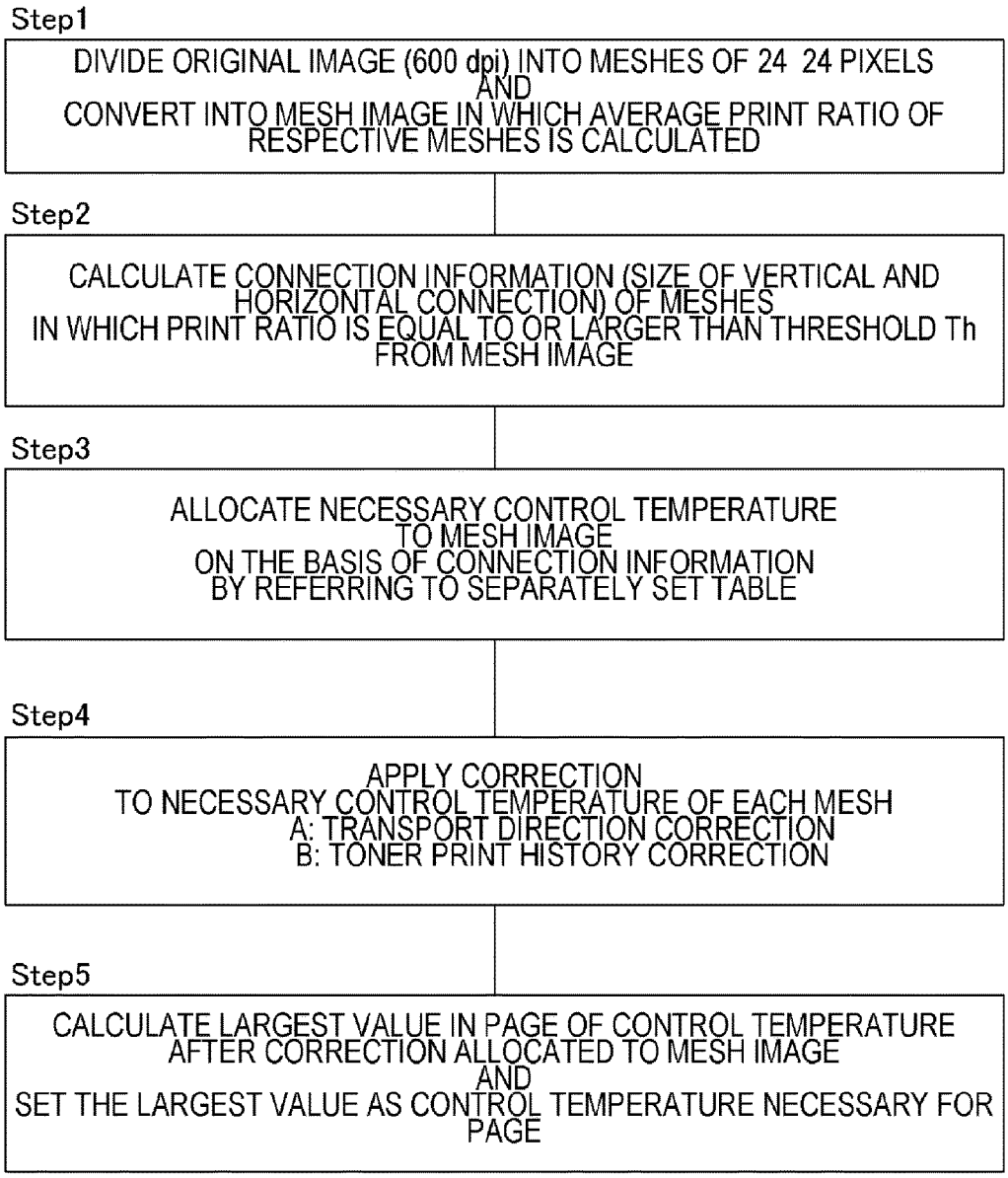
FIG. 5 is a flowchart of calculating a temperature required for fixing according to an invention of Embodiment 1.

FIG. 5 and FIGS. 6A to 6F illustrate a method of calculating the temperature required for fixing in the image analysis portion 401. FIG. 5 is a processing flowchart when calculating the temperature required for fixing using the calculation method. FIGS. 6A to 6F are schematic diagrams illustrating the content of the processes illustrated in the flowchart of FIG. 5.

The respective steps of the flowchart of the temperature required for fixing calculation method illustrated in FIG. 5 will be described in detail.

Step 1

An original image (600 dpi) is divided into meshes M (regions) made up of a plurality of pixels (a plurality of picture elements) and is converted to an mesh image in which an average print ratio of each mesh M (that is, an average value of the ratios that respective pixels included in one mesh M include dots (dots on which toner is laid) serving as image portions) is calculated. Data in which the mesh images are summarized in the entire image corresponds to conversion data of the present invention. Although the size of one side of the mesh M is preferably set to approximately 0.25 mm (8 pixels) to 5 mm (120 pixels), the size is set to 24 pixels by 24 pixels in the present embodiment. The size of one mesh in the present embodiment is approximately 1 mm by 1 mm. Although the necessary control temperature is set according to the length of connection of meshes M in the present embodiment, if the mesh M is too small, it becomes hypersensitive to a very small space between pieces of image data. Moreover, the amount of data to be handled becomes too large. If the mesh M is too large, the detailed data in the mesh M disappears when the original image is converted into a mesh image and image patterns that are to be handled as discrete arrangements may be regarded as a continuous pattern. Therefore, the size of one mesh is set appropriately by taking balance with these factors into consideration.

Figures 6A, 6B, 6C, 6D, 6E, 6F:
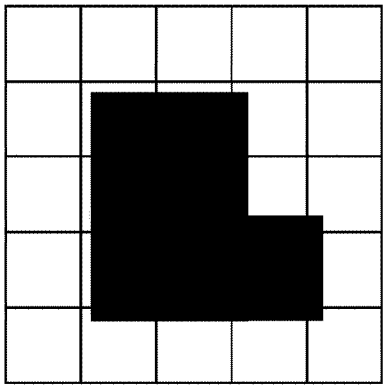
FIGS. 6A to 6F are schematic diagrams illustrating the process of calculating the temperature required for fixing according to an invention of Embodiment 1.

An original image in which solid black data as illustrated in FIG. 6A is disposed is divided into meshes M including 24 by 24 pixels. In FIGS. 6A to 6F, a region of 5 by 5 meshes is illustrated as a representative example as a portion of the image data, and one cell partitioned vertically and horizontally corresponds to one mesh. As illustrated in FIG. 6B, each mesh M is converted into a mesh image by calculating an average print ratio of each pixel in the mesh M. In FIG. 6B, the average print ratios of the respective meshes M are calculated using 100% as the largest value.

In the present embodiment, although the average print ratio of respective pixels is calculated as the mesh data of each mesh M, the mesh data is not limited thereto, and a median value may be used, for example. The most frequent value or the other representative values may be used.

Figure 7:
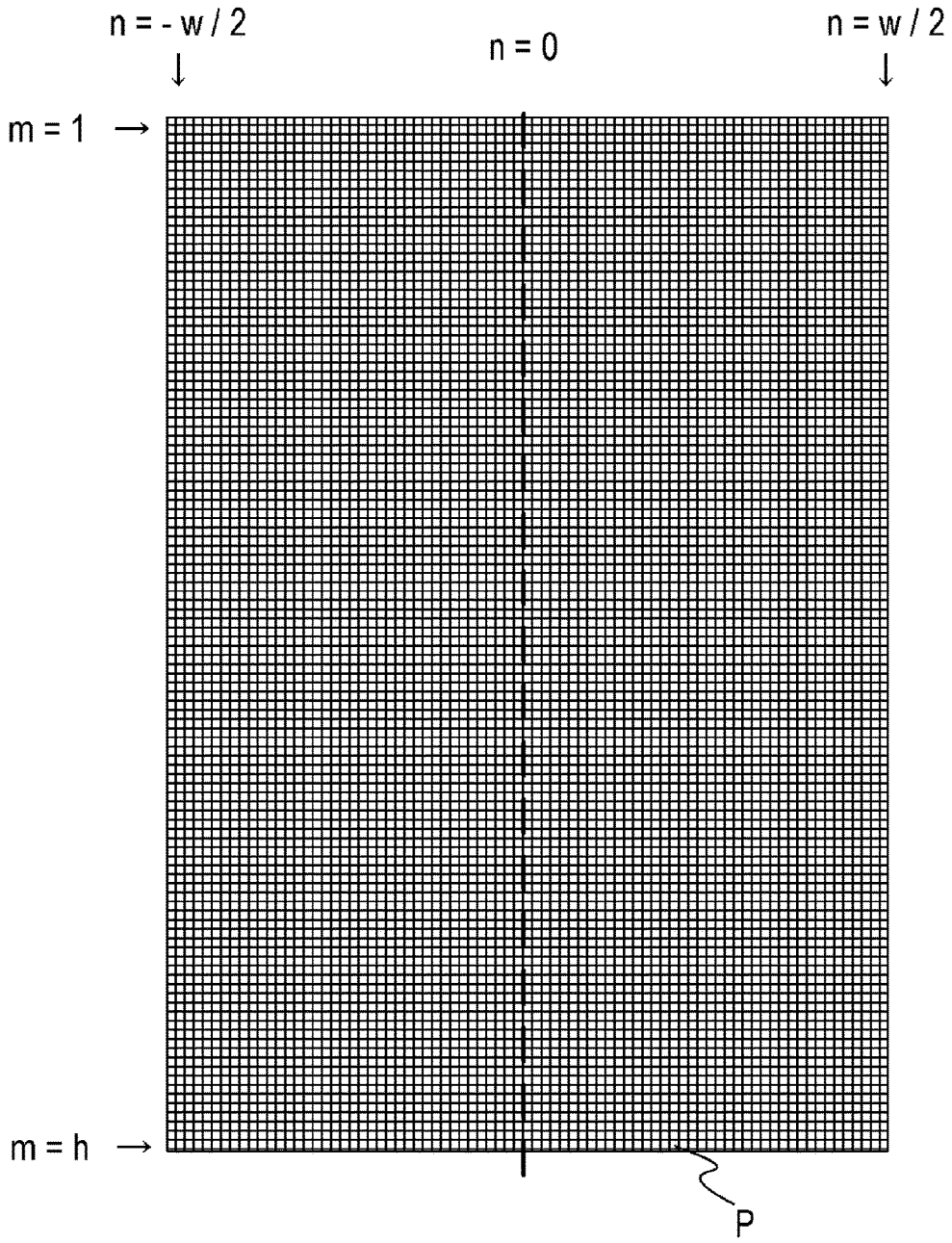
FIG. 7 is a diagram for describing the position of a mesh M according to an invention of Embodiment 1.

The average print ratio of each mesh M(m,n) is defined as R(m,n). As illustrated in FIG. 7, m is the number in a vertical direction (the transport direction of a recording material) of the mesh M, and n is the number in a horizontal direction (the direction orthogonal to the transport direction of the recording material). m is the number counted from the leading end of a recording material and is a positive integer of 1 or more. n is an integer when the mesh M including the center in the longitudinal direction is set to 0. The largest value $m_{max}$ of m is the length h (mm) of a recording material. The smallest value $n_{min}$ and the largest value $n_{max}$ of n are determined by the width w (mm) of the recording material, and the smallest value $n_{min}$ is −w/2 and the largest value $n_{max}$ is w/2. When the number of pixels is not an integer multiple of the number of meshes M, pixels remaining after allocating meshes M is not subjected to an image analysis process. However, since an actual printing region is set with a mask region of 2 mm from the end of a recording material, there is no influence therefrom.

Step 2

The image analysis portion 401 is a continuity acquiring portion and calculates the connection information (the sizes of connection in vertical and horizontal directions, that is, the number of continuously adjacent predetermined meshes) of predetermined meshes M having a print ratio R(m,n) of a threshold Th or more from a mesh image. In the present embodiment, a vertical connection length and a horizontal connection length are calculated for meshes M having a high print ratio of 50% or more of a threshold from the mesh image illustrated in FIG. 6B. In this calculation, the vertical connection length and the horizontal connection length are calculated for an image which is two-valued on the basis of the threshold Th as illustrated in FIG. 6C.

Each of the two-valued meshes M is defined as E(m,n).

$$E(m,n)=1 \text{ (if } R(m,n)\geq Th)$$

$$0(\text{if } R(m,n)<Th) \qquad \text{Equation 1}$$

When a horizontal connection length Lh(m,n) is calculated, first, the number of continuous meshes M of which the print ratio exceeds the threshold is counted in the leftward direction from the mesh M of which the print ratio is equal to or larger than the threshold, for example. Subsequently, the number is counted in the rightward direction and the sum is calculated. By doing so, the horizontal connection length of the mesh M can be calculated. Moreover, the number of continuous meshes M of which the print ratio is equal to or larger than the threshold may be counted from the left side for all meshes M, and the numbers of continuous meshes may be filled into the meshes M from the count start position to the count end position. Furthermore, the edges of the two-valued mesh image illustrated in FIG. 6C may be detected, and the number of continuous meshes may be calculated from the coordinates of the edges. These calculation methods may be selected appropriately according to conditions such as the number of picture elements, the size of the mesh M, or the memory size, and other methods illustrated herein may be used. The vertical connection length Lv(m,n) can be calculated in a similar manner.

FIG. 6D illustrates a calculation result of the vertical connection length Lv(m,n) for the two-valued mesh image illustrated in FIG. 6C. FIG. 6E illustrates a calculation result of the horizontal connection length Lh(m,n) for the two-valued mesh image illustrated in FIG. 6C.

The connection length may be calculated after creating the two-valued mesh image illustrated in FIG. 6C, and the connection length may be calculated directly for the meshes M of which the print ratio is equal to or larger than the threshold Th from the mesh image illustrated in FIG. 6B.

Step 3

The necessary control temperature is allocated to each mesh image on the basis of the connection information calculated in Step 2 and by referring to a separately set table. In Step 2, vertical and horizontal connection size information is calculated for each mesh M(m,n). On the basis of the calculation result, in Step 3, by referring to a control temperature setting table set separately as illustrated in Table 1, a value obtained by referring to the vertical connection length Lh(m,n), the horizontal connection length Lv(m,n), and the table is set to each mesh M(m,n). For example, when the vertical connection length is 3 and the horizontal connection length is 2, temperature T3_2 is allocated to the mesh M(m,n) by referring to Table 1. For meshes M(m,n) in which a value of 0 is filled in FIG. 6C, temperature T0_0 is allocated to the meshes M. This value is the control temperature T(m,n) necessary for fixing the mesh M(m,n) at that position. Basically, the table is set so that a high control temperature is set for a mesh M having a large connection length. Moreover, in the present embodiment, since the fixing performance does not change greatly for an image having a connection length of 10 mm or more, the same control temperature as that of an image having a connection length of 10 meshes is set for the mesh M(m,n) having a connection length of 10 meshes or more. However, the table may be changed appropriately depending on a fixing configuration or the like.

In the present embodiment, although the control temperature value is set directly in the table, a correction value for a reference control temperature may be used, a value correlated with the necessary control temperature may be used, and a value correlated with the fixing performance may be used.

TABLE 1

Control Temperature Setting Table

| | | Lh | | | | | | | | | | |
|---|---|---|---|---|---|---|---|---|---|---|---|---|
| | | 0 | 1 | 2 | 3 | 4 | 5 | 6 | 7 | 8 | 9 | ≥10 |
| Lv | 0 | $T_{0_0}$ | — | — | — | — | — | — | — | — | — | — |
| | 1 | — | $T_{1_1}$ | $T_{1_2}$ | $T_{1_3}$ | $T_{1_4}$ | $T_{1_5}$ | $T_{1_6}$ | $T_{1_7}$ | $T_{1_8}$ | $T_{1_9}$ | $T_{1_10}$ |
| | 2 | — | $T_{2_1}$ | $T_{2_2}$ | $T_{2_3}$ | $T_{2_4}$ | $T_{2_5}$ | $T_{2_6}$ | $T_{2_7}$ | $T_{2_8}$ | $T_{2_9}$ | $T_{2_10}$ |
| | 3 | — | $T_{3_1}$ | $T_{3_2}$ | $T_{3_3}$ | $T_{3_4}$ | $T_{3_5}$ | $T_{3_6}$ | $T_{3_7}$ | $T_{3_8}$ | $T_{3_9}$ | $T_{3_10}$ |
| | 4 | — | $T_{4_1}$ | $T_{4_2}$ | $T_{4_3}$ | $T_{4_4}$ | $T_{4_5}$ | $T_{4_6}$ | $T_{4_7}$ | $T_{4_8}$ | $T_{4_9}$ | $T_{4_10}$ |
| | 5 | — | $T_{5_1}$ | $T_{5_2}$ | $T_{5_3}$ | $T_{5_4}$ | $T_{5_5}$ | $T_{5_6}$ | $T_{5_7}$ | $T_{5_8}$ | $T_{5_9}$ | $T_{5_10}$ |
| | 6 | — | $T_{6_1}$ | $T_{6_2}$ | $T_{6_3}$ | $T_{6_4}$ | $T_{6_5}$ | $T_{6_6}$ | $T_{6_7}$ | $T_{6_8}$ | $T_{6_9}$ | $T_{6_10}$ |
| | 7 | — | $T_{7_1}$ | $T_{7_2}$ | $T_{7_3}$ | $T_{7_4}$ | $T_{7_5}$ | $T_{7_6}$ | $T_{7_7}$ | $T_{7_8}$ | $T_{7_9}$ | $T_{7_10}$ |
| | 8 | — | $T_{8_1}$ | $T_{8_2}$ | $T_{8_3}$ | $T_{8_4}$ | $T_{8_5}$ | $T_{8_6}$ | $T_{8_7}$ | $T_{8_8}$ | $T_{8_9}$ | $T_{8_10}$ |
| | 9 | — | $T_{9_1}$ | $T_{9_2}$ | $T_{9_3}$ | $T_{9_4}$ | $T_{9_5}$ | $T_{9_6}$ | $T_{9_7}$ | $T_{9_8}$ | $T_{9_9}$ | $T_{9_10}$ |
| | ≥10 | — | $T_{10_1}$ | $T_{10_2}$ | $T_{10_3}$ | $T_{10_4}$ | $T_{10_5}$ | $T_{10_6}$ | $T_{10_7}$ | $T_{10_8}$ | $T_{10_9}$ | $T_{10_10}$ |

A control temperature setting table used actually in the present embodiment is illustrated as below.

TABLE 2

Control Temperature Setting Table Used in Present Embodiment

| | | Lh | | | | | | | | | | |
|---|---|---|---|---|---|---|---|---|---|---|---|---|
| | | 0 | 1 | 2 | 3 | 4 | 5 | 6 | 7 | 8 | 9 | ≥10 |
| Lv | 0 | 180 | — | — | — | — | — | — | — | — | — | — |
| | 1 | — | 185 | 185 | 185 | 185 | 185 | 185 | 186 | 186 | 197 | 187 |
| | 2 | — | 185 | 185 | 185 | 185 | 185 | 185 | 186 | 186 | 197 | 187 |
| | 3 | — | 185 | 185 | 185 | 186 | 186 | 185 | 186 | 187 | 188 | 188 |
| | 4 | — | 185 | 186 | 186 | 187 | 187 | 186 | 187 | 188 | 188 | 189 |
| | 5 | — | 185 | 187 | 188 | 188 | 188 | 188 | 188 | 188 | 189 | 190 |
| | 6 | — | 185 | 187 | 189 | 189 | 189 | 189 | 189 | 189 | 190 | 191 |
| | 7 | — | 185 | 188 | 190 | 190 | 190 | 190 | 190 | 190 | 190 | 191 |
| | 8 | — | 185 | 188 | 190 | 190 | 190 | 190 | 190 | 190 | 191 | 191 |
| | 9 | — | 185 | 188 | 190 | 190 | 190 | 190 | 190 | 191 | 191 | 191 |
| | ≥10 | — | 185 | 188 | 190 | 190 | 190 | 190 | 191 | 191 | 191 | 192 |

Step 4

Correction is applied to the control temperature necessary for fixing the respective meshes M(m,n) allocated in Step 3.

In the present embodiment, two corrections including transport direction correction A and toner print history correction B are performed.

A: Transport Direction Correction

The control temperature allocated to the respective meshes M(m,n) is corrected depending on the position in the transport direction of the mesh M. A correction value TA(m,n) is applied to the respective meshes M(m,n) as below depending on the position m from the leading end of the recording material.

TABLE 3

| Transport Direction Correction | |
|---|---|
| m | Correction value TA (n, m) |
| ~57 | 0 |
| 58~114 | 0.5 |
| 115~171 | 1 |
| 172~228 | 1.5 |
| 229~ | 2 |

B: Toner Print History Correction

When a fixing operation is performed on a portion on which toner is printed, since heat is taken away from a fixing film to melt down the toner, the film temperature in the corresponding portion decreases. When a fixing operation is performed after the film in the portion where the temperature has decreased makes one rotation, since the film temperature in the corresponding portion has decreased a little, it is necessary to set the control temperature to be high. That is, the control target temperature in a mesh on an upstream side on which the mesh makes contact with a film region which already made contact with a mesh on a downstream side in the transport direction of a recording material among meshes of image data is corrected to a temperature higher than that before the correction. In the present embodiment, when print data is present in meshes M(m-57,n), M(m-114,n), M(m-171,n), and M(m-228,n), the film cycle before of a certain M(m,n), correction is performed with respect to the mesh M(m,n). That is, 57 meshes correspond to approximately a circumferential length (the length in the transport direction of the recording material) of the film.

A correction value of a mesh M(m,n) at a certain position (m,n) is calculated. A correction value TB(m,n) is calculated by the following equation.

$$TB(m,n) = a \times E(m-57,n) + b \times E(m-114,n) + c \times E(m-171,n) + d \times E(m-228,n) \quad \text{Equation 2}$$

a, b, c, and d are coefficients, and in the present embodiment, are set such that a=3.0, b=1.5, c=1.0, and d=0.5. This calculation process is not performed when a calculation target is outside the region of a recording material. For example, when m of a mesh M is between 58 and 114, although meshes M, one film cycle before of the mesh M are present, since meshes M, two film cycles before of the mesh M are not present, the calculation is performed up to the first term on the right side.

A temperature required for fixing Tf(m,n) after correction of each mesh M(m,n) is calculated as below.

$$Tf(m,n)=T(m,n)+TA(m,n)+TB(m,n) \quad \text{Equation 3}$$

Step 5

In Step 4, the largest value of the temperature required for fixing Tf(m,n) after correction of each mesh M(m,n) is calculated for meshes M in one page of a recording material, and the largest value is used as a control temperature Tp necessary for that page.

$$Tp = \max_{\substack{1 \le m \le m_{max} \\ n_{min} \le n \le n_{max}}} Tf(m,n) \quad \text{Equation 4}$$

For example, when a solid black pattern is printed on an entire surface of an A4-size recording material, T=192° C. referring to Table 2, TA=2° C. referring to Table 3, and TB=6° C. referring to Equation 2 for meshes near the trailing end of the recording material. Moreover, Tf=200° C. referring to Equation 3, and a control temperature of the page is Tp=200° C. Similarly, when a solid white pattern is printed, T=180° C. referring to Table 2, TA=2° C. referring to Table 3, and TB=0° C. referring to Equation 2 for meshes near the trailing end of the recording material. Moreover, Tf=182° C. referring to Equation 3, and a control temperature of the page is Tp=182° C.

In the present embodiment, fixing temperature control to be described later is performed using the temperature required for fixing Tp of a detection image calculated according to the above-described steps.

Fixing Control Portion of Present Embodiment

Figure 8:
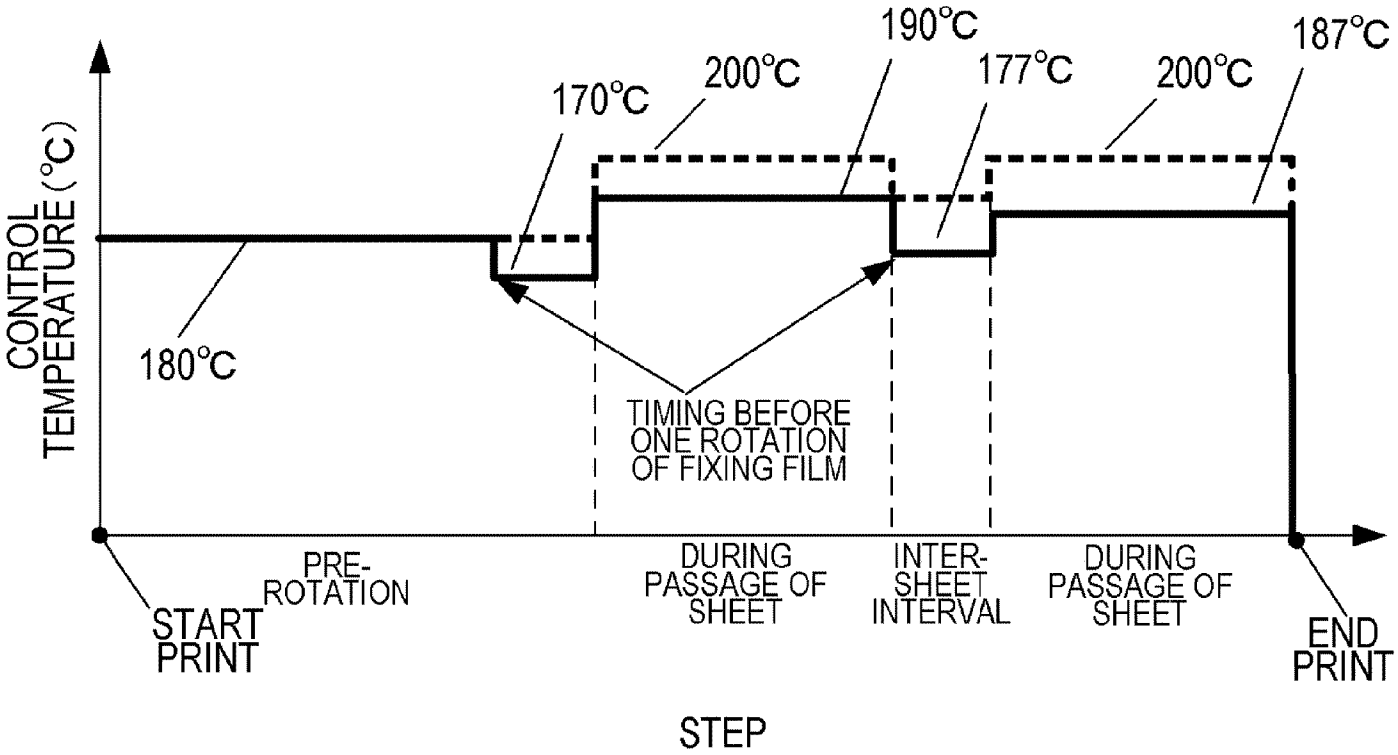
FIG. 8 is a diagram for describing a fixing control sequence of correcting a control temperature according to an invention of Embodiment 1.

FIG. 8 is a diagram for describing a fixing temperature control sequence of correction the temperature on the basis of the image analysis according to the present invention. A dot line portion in FIG. 8 indicates the temperature settings in a basic sequence of the present embodiment, and a solid line portion indicates the temperature settings based on the temperature required for fixing Tp when the control is changed according to the temperature required for fixing of the present embodiment.

When a print command and an image is transmitted to the controller interface 305 by the host computer 300, the image analysis portion 401 calculates the control temperature Tp on the basis of the image information received from the image processing portion 303. Subsequently, the engine control portion 302 starts a print operation on the basis of a signal from the controller portion 301. When a print operation starts, the apparatus starts operating at the setting temperature of 180° illustrated in FIG. 8. The control temperature during passage of sheet is set to 200° C. as the control temperature setting when the control temperature Tp is not notified according to the method of the present embodiment. In this case, the temperature is controlled according to the dot line in FIG. 8. When the temperature changes from a pre-rotation control temperature to the temperature during passage of sheet of 200° C. and the trailing end of a recording material passes through the fixing nip, the control temperature changes to 190° C. and changes to 200° C. when the next recording material passes. When such control temperature setting is used, it is possible to fix an arbitrary image pattern.

Subsequently, as a fixing operation of the present embodiment, the control temperature Tp calculated by the method described in the present embodiment, corresponding to a first page of images is received at a timing one rotation of the fixing film before a timing at which the leading end of the first page of a recording material enters the fixing nip, and the control temperature is changed. The control temperature for the first page of a recording material indicated by a solid line in FIG. 8 illustrates the case of Tp=190° C.

If the control temperature is changed to a low temperature from a timing at which the leading end of the recording material enters the fixing nip, since the film is warmed up due to the pre-rotation control temperature, the amount of heat that the leading end of the recording material receives actually becomes too large. Therefore, in the present embodiment, the control temperature is changed from the pre-rotation control temperature of 180° C. to Tp−20° C. at a timing at which the recording material enters the fixing nip and which is before one rotation of the fixing film. That is, the pre-rotation control temperature before one rotation of the film is changed from 180° C. to 170° C. During passage of the sheet, the control temperature is set to the calculated control temperature Tp of the first page.

After that, when the trailing end of the recording material passes through the fixing nip, the control temperature is changed depending on the control temperature Tp calculated by the method described in the present embodiment, corresponding to the toner image printed on a subsequent recording material. FIG. 8 illustrates the case of Tp=187° C. For the subsequent sheet, the control temperature calculated on the basis of the image information of the subsequent sheet is changed to Tp−10° C. That is, the control temperature is changed to 177° C. During passage of the sheet, the control temperature Tp calculated for the second page is set. The fixing operation ends when the trailing end of the recording material passes through the fixing nip and there is no subsequent sheet.

By performing control in the above-described manner, in the present embodiment, it is possible to provide an image forming apparatus which provides satisfactory fixing performance regardless of an image pattern and suppresses unnecessary power consumption to provide excellent energy saving properties.

Description of Advantages of Present Embodiment

Next, the advantages of the present embodiment will be described.

Figure 9A:
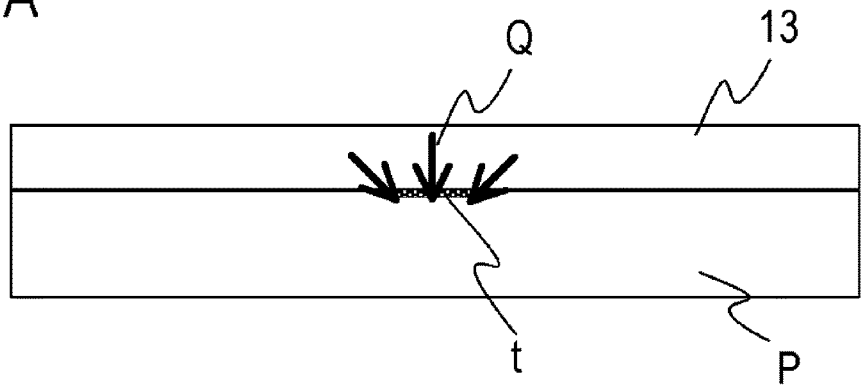
FIGS. 9A and 9B are diagrams when toner images having different line widths are fixed.
Figure 9B:
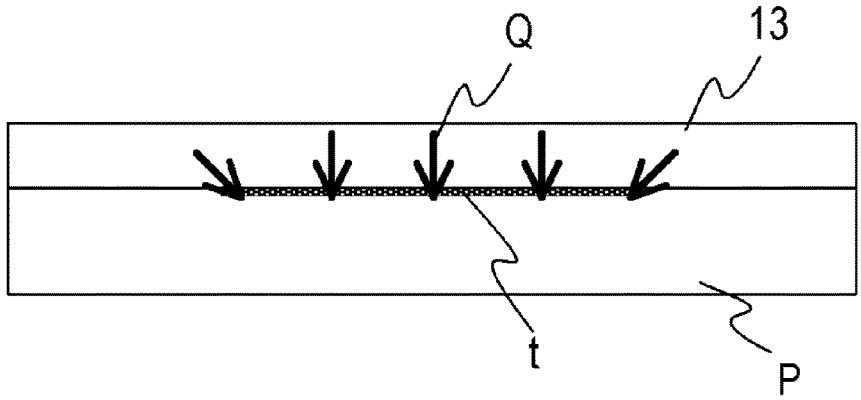

First, the flow of heat when images with a small line width and a large line width are printed on a recording material P and a fixing operation is performed will be described with reference to FIGS. 9A and 9B. FIG. 9A illustrates a case in which an image having a narrow line (that is, meshes that do not form a predetermined connection or a group of meshes in which the size of the predetermined connection is small among predetermined meshes of which the mesh data is equal to or larger than a predetermined threshold) is formed on the recording material P. FIG. 9B illustrates a case in which an image having a bold line (that is, a group of meshes in which the predetermined connection has a considerable size) is formed. In FIG. 9A, a heat flow Q can be received from a portion adjacent to a region in which toner t is printed on a recording material since the line is narrow. In contrast, in FIG. 9B, a region in which a heat flow Q can be received from a portion adjacent to a region in which toner t is provided on a recording material is limited since the line is bold. As a result, the amount of heat received from the present position information per unit area of the region in which toner is printed in FIG. 9A is larger than that of FIG. 9B. Therefore, the fixing performance of the image having a small line width as illustrated in FIG. 9A is better than that of FIG. 9B. That is, the image can be fixed with a lower control temperature.

Figure 10A:
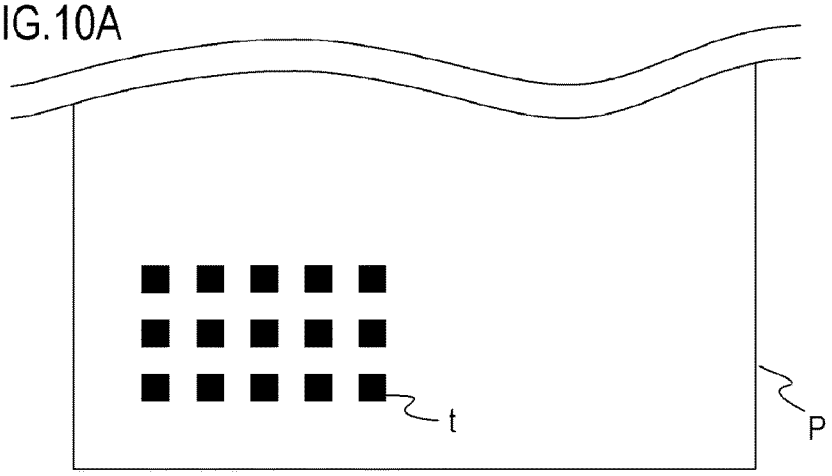
FIGS. 10A to 10C are diagrams for describing images used in tests according to an invention of Embodiment 1.
Figure 10B:
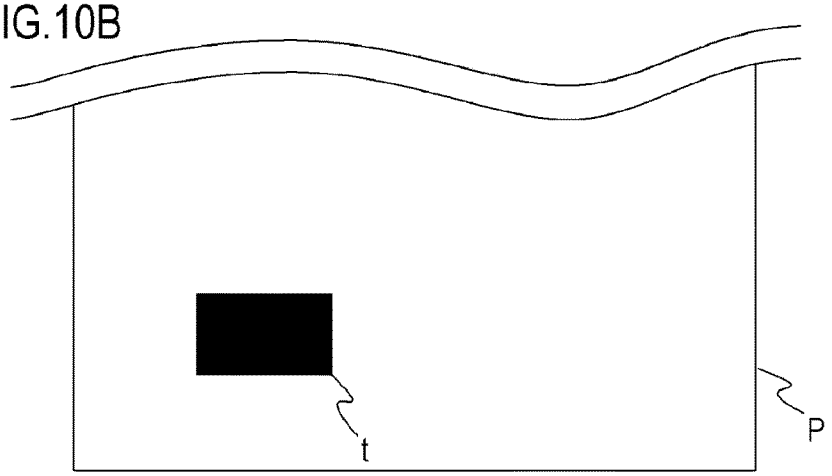
Figure 10C:
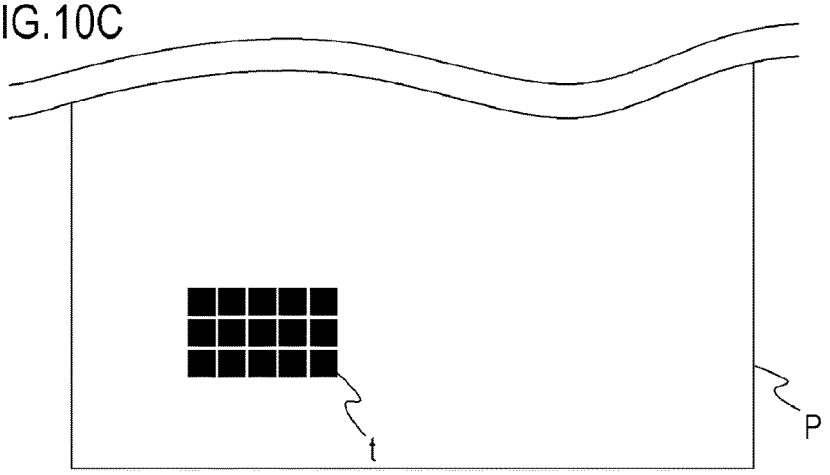

Next, a conventional detection method and a detection method of the present embodiment when an image pattern is printed are compared using FIGS. 10A to 10C. As illustrated in FIGS. 10A to 10C, a solid black pattern is printed approximately at the same positions of the trailing end of the recording material P. An image a illustrated in FIG. 10A is 4-mm-square solid black patterns which are arranged at intervals of 4 mm and are made up of three vertical patterns and five horizontal patterns. An image b illustrated in FIG. 10B is a pattern in which the interval between the patterns of the image a disappears so that the patterns are connected into one cluster. That is, the image b is a solid black pattern that is 12 mm in a vertical direction and 20 mm in a horizontal direction. An image c illustrated in FIG. 10C is a pattern in which the interval between the 4-mm-square patterns of the image a is changed to 0.2 mm. The printing areas of the three images in FIGS. 10A to 10C are the same.

Table 4 illustrates the examination results of the temperature necessary for fixing the three images. The image a can be fixed with a lower control temperature than that of the image b. As described above, this is because the fixing performance of such a discrete pattern as the image a is better than that of such a fixed pattern as the image b due to whirling of heat. However, when the interval is small as in the image c, since a sufficient whirling effect of heat is not obtained, a high control temperature is necessary similarly to the image b.

TABLE 4

Detection Method for Images in FIGS. 10A to 10C

| | | Detection method | | | |
|---|---|---|---|---|---|
| Image | Temperature necessary for fixing | Present embodiment | Comparative example 1 | Comparative example 2 | Comparative example 3 |
| a | Low | Set to low | Set to constant | Set to constant | Set to low |
| b | High | Set to high | | | Set to high |
| c | High | Set to high | | | Set to low |

Next, an image analysis method will be compared. Comparative example 1 is a case in which an image is detected with a largest toner laid-on level, Comparative example 2 is a case in which an image is detected with a print ratio, and Comparative example 3 is a case in which an image is detected with the size of a solid black pixel. Table 4 illustrates how a control temperature can be set for the respective images when the images are detected by the respective methods. Since an image is detected with a largest toner laid-on level in Comparative example 1, different detection results are not obtained for three images having the same largest toner laid-on level, and the control temperature setting cannot be changed. Since an image is detected with a toner print ratio in Comparative example 2, different detection results are not obtained for three images having the same area, and the control temperature setting cannot be changed. Although the image b can be detected appropriately in Comparative example 3 since the size of the solid black pixel is larger than that of the image a. However, since the image c is detected as a solid black pattern having a small size, the control temperature of the image c is set similarly to the image a. As a result, fixing failures may occur when a pattern like the image c is printed.

In the method of the present embodiment, as described above, an original image is divided into meshes M including 24 by 24 pixels, and an appropriate control temperature is allocated according to the connection information of the mesh image in which the calculated average print ratio of the respective meshes M is equal to or larger than the threshold Th. Since the connection length of the mesh image of the images b and c is large as compared to the image a, the images b and c can be appropriately detected separately. When the images b and c are converted to mesh images and are cut by the threshold Th, a small interval of the image c is filled. Therefore, substantially similar detection results are obtained for the images b and c without being hypersensitive to a very small space. Therefore, a high control temperature can be set to the images b and c. That is, an appropriate control temperature can be set for the three images.

As described above, the image forming apparatus of the present embodiment can set the control temperature appropriately for the respective images by performing image analysis according to the above-described method and control the fixing temperature optimal for the image pattern. Moreover, since a necessary control temperature is allocated to respective meshes, correction can be performed easily depending on a position. In this way, it is possible to provide an image forming apparatus having satisfactory energy saving performance while obtaining a satisfactory fixing performance regardless of an image pattern.

Although printing is performed by connecting the host computer 300 to the image forming apparatus 100 of the present embodiment, printing may be performed by connecting a computer connected on a network or a print server instead of the host computer 300. Although the image processing portion 303 on the controller 301 performs the image analysis and calculates the control temperature correction amount, the present invention is not limited thereto. Either the image analysis or the calculation of the control temperature correction amount may be performed by a host computer, a printer on a network, and a program possessed by a print server.

Although the size of the mesh M set in the present embodiment is 24 pixels by 24 pixels, the present embodiment is not intended to restrict the region but the size and the shape of the detection region may be changed according to the characteristics of the image forming apparatus.

The control temperature correction calculated in the present embodiment may be changed on the basis of a fixing mode for determining the control temperature, ambient environment information detected by an environment detection unit (not illustrated), a recording material type detected by a media sensor (not illustrated).

In the fixing control of the present embodiment, although the control temperature only is changed, the gain of PID control and an offset electric energy used in the control temperature control may be changed.

In the fixing control of the present embodiment, although the control temperature is changed before a recording material including a detection image enters the fixing nip, the control temperature may be changed before the toner image of an image analyzed by the image analysis unit enters the fixing nip and may be changed in an earlier stage.

In the present embodiment, although one detection result is calculated for one page, there is no limitation thereto. For example, meshes may be grouped in respective regions in the transport direction corresponding to the fixing film cycle, the optimal control temperature in the respective groups may be calculated, and the control temperature in the page may be changed.

In the present embodiment, although the calculation processing procedure of the image analysis portion 401 has been performed on an image on which the processing of the other image processing portions 402 has been finished, the calculation process may be performed before the processing of the other image processing portions 402 is performed.

Embodiment 2

Embodiment 2 of the present invention will be described. In Embodiment 2, another correction is applied to a detection result according to a mesh position n in the horizontal direction in addition to Embodiment 1. The fixing performance at both ends of a recording material P may be poor than the central portion depending on the configuration of a fixing apparatus to be used and the size of the recording material P being passed. Moreover, when a member having a large heat capacity is locally in contact with a portion of a rear surface of the heating heater 11, the flash-side pool address space of the corresponding portion may be poor than the other portions. For example, a configuration in which a safety element such as a thermo switch or a temperature fuse that operates in response to abnormal heating of a heater to interrupt the supply of electric power to the heater comes into direct contact with the heater or indirectly with a holding member or the like disposed therebetween may be used. It is necessary to set the control temperature necessary for fixing the corresponding portion to be high.

Hereinafter, Embodiment 2 as countermeasures against decrease in the fixing performance at both ends of the recording material P will be described. A basic configuration of the image forming apparatus of Embodiment 2 and processes other than image analysis are similar to those of Embodiment 1 and the description thereof will be omitted. In the present embodiment, a correction method when the fixing performance at an end is poor will be described.

Figure 11:
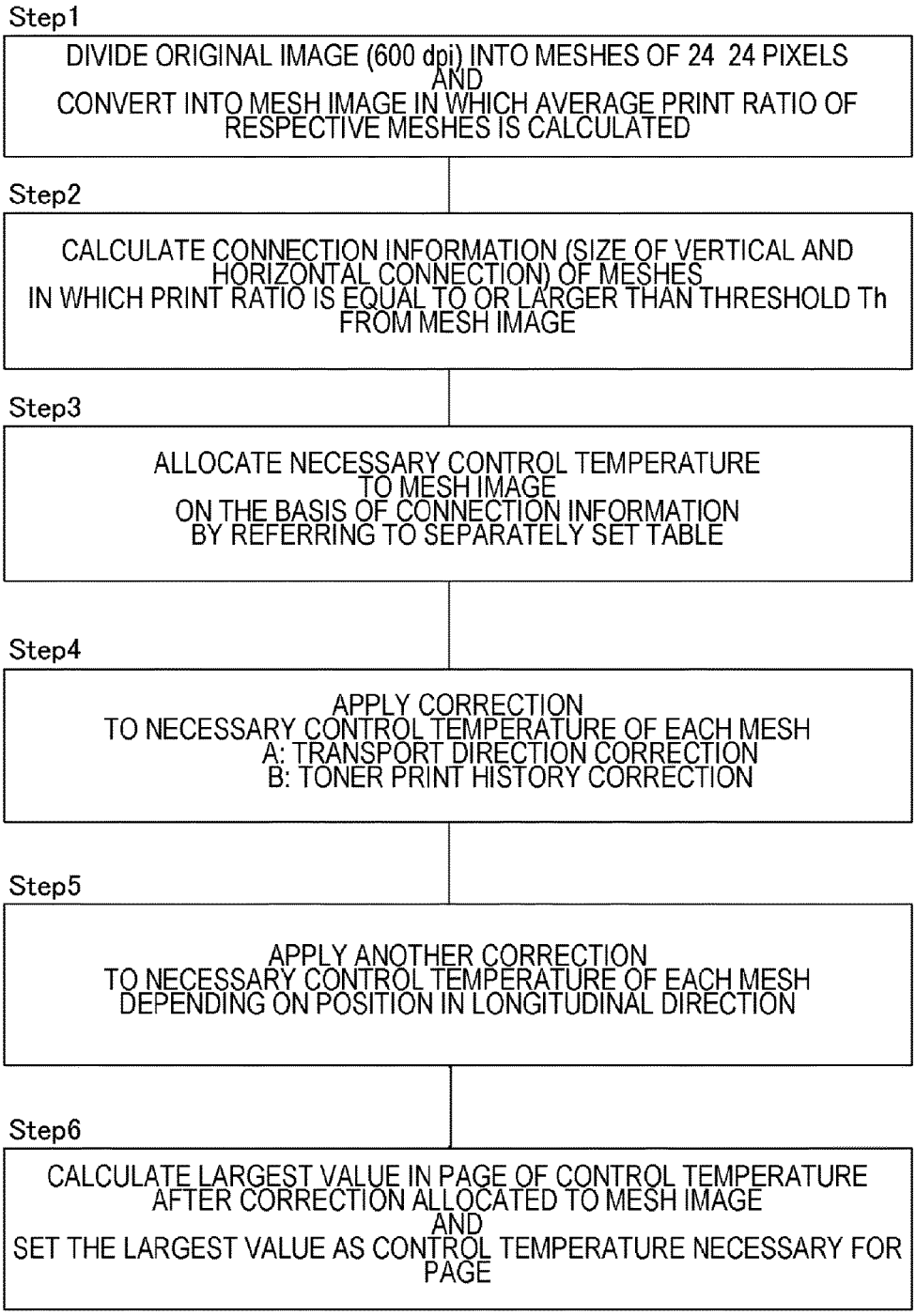
FIG. 11 is a flowchart of calculating a temperature required for fixing according to an invention of Embodiment 2.

The correction method will be described according to the flowchart of a temperature required for fixing calculation method illustrated in FIG. 11.

Characteristics of Image Analysis

Steps 1 to 4

Steps 1 to 4 are similar to those of Embodiment 1 and the description thereof will be omitted.

Step 5

In the present embodiment, another correction is applied to the detection results of the temperature required for fixing Tf(m,n) of each mesh M(m,n), to which correction in the transport direction has been made in Step 4, according to the position in the longitudinal direction. Specifically, correction TC(m,n) of the present embodiment is applied according to the following equation. In the present embodiment, correction is performed when a recording material has the LTR size (216 mm×279 mm) which is the largest sheet passing width. The present control is not effective in A4-size sheets since the A4-size sheet has a narrower width than the LTR-size sheet and the fixing performance at an end does not decrease.

$$Tf'(m,n)=Tf(m,n)+TC(m,n)$$

$$TC(m,n)=5 \text{ (if } n\leq -100,\ 100\leq n)$$

$$TC(m,n)=0 \text{ (if } -100<n<100) \qquad \text{Equation 5}$$

Figure 12A:
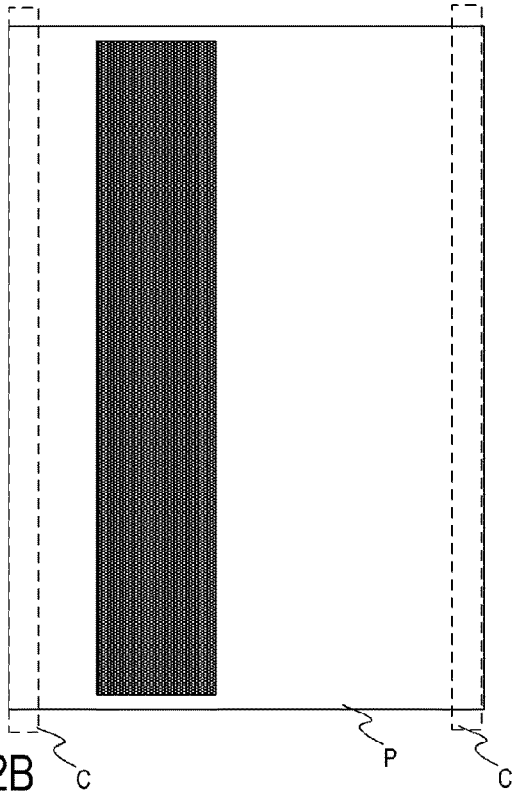
FIGS. 12A and 12B are diagrams for describing images according to an invention of Embodiment 2.

This equation means that the temperature required for fixing is corrected by 5° C. for a mesh M(m,n) positioned in the regions that are 3 mm from the left and right ends of an image printing region which is a region of an LTR-size recording material excluding the margin of 5 mm from the left and right ends of the recording material. That is, when such a rectangular image as in FIG. 12A and such a rectangular image as in FIG. 12B which is at a different position from the image of FIG. 12A are compared, a correction value TC is applied to a region C surrounded by a broken line and positioned at an end of the rectangle. Therefore, the temperature required for fixing of a mesh portion positioned in a solid black image in the region C surrounded by a broken line in FIG. 12B, positioned at an end of the rectangle where the fixing performance is weak increases.

Step 6

Similarly to Embodiment 1, in Step 5, the largest value of the temperature required for fixing Tf'(m,n) after correction of each mesh M is calculated for meshes M in one page of a recording material, and the largest value is used as a control temperature Tp necessary for that page.

$$Tp = \max_{\substack{1 \le m \le m_{max} \\ n_{min} \le n \le n_{max}}} Tf'(m, n) \qquad \text{Equation 6}$$

Figure 12B:
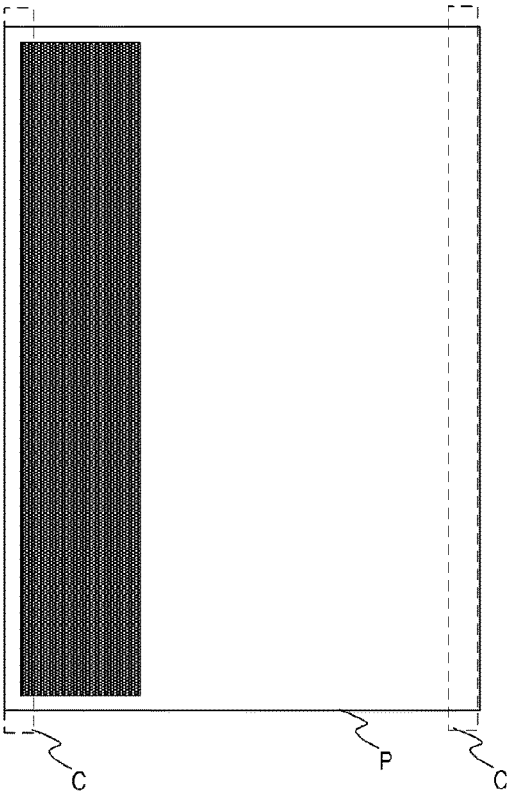

When the calculation process is performed as in the present embodiment, the control temperature may be increased when an image having a poor fixing performance is present in the extreme ends as illustrated in FIG. 12B. Therefore, it may be possible to decrease the control temperature appropriately depending on an image as compared to a case in which the control temperature is increased uniformly in order to secure the fixing performance at positions where the fixing performance is poor. Therefore, it is possible to provide an image forming apparatus having a satisfactory energy saving performance while obtaining a satisfactory fixing performance.

Although the temperature required for fixing at the ends is corrected in the present embodiment, similar advantages can be obtained when the necessary control temperature is calculated for respective rectangular regions, and the optimal control temperature is calculated for respective regions and transmitted to an engine control portion so that the engine control portion performs correction and determines a final control temperature.

Embodiment 3

Embodiment 3 of the present invention will be described. In Embodiment 3, another correction is applied to a detection result according to a print ratio of a region in which a temperature detection element is positioned in addition to Embodiment 1. When an image is formed in the region of a temperature detection element, a large amount of electric power is supplied to maintain the temperature constant since heat is taken away from the film to melt down toner. Variations in the fixing performance associated with this are estimated and the control temperature is set appropriately. A basic configuration of the image forming apparatus of Embodiment 3 and the image analysis process are similar to those of Embodiment 1 and the description thereof will be omitted.

Figure 13:
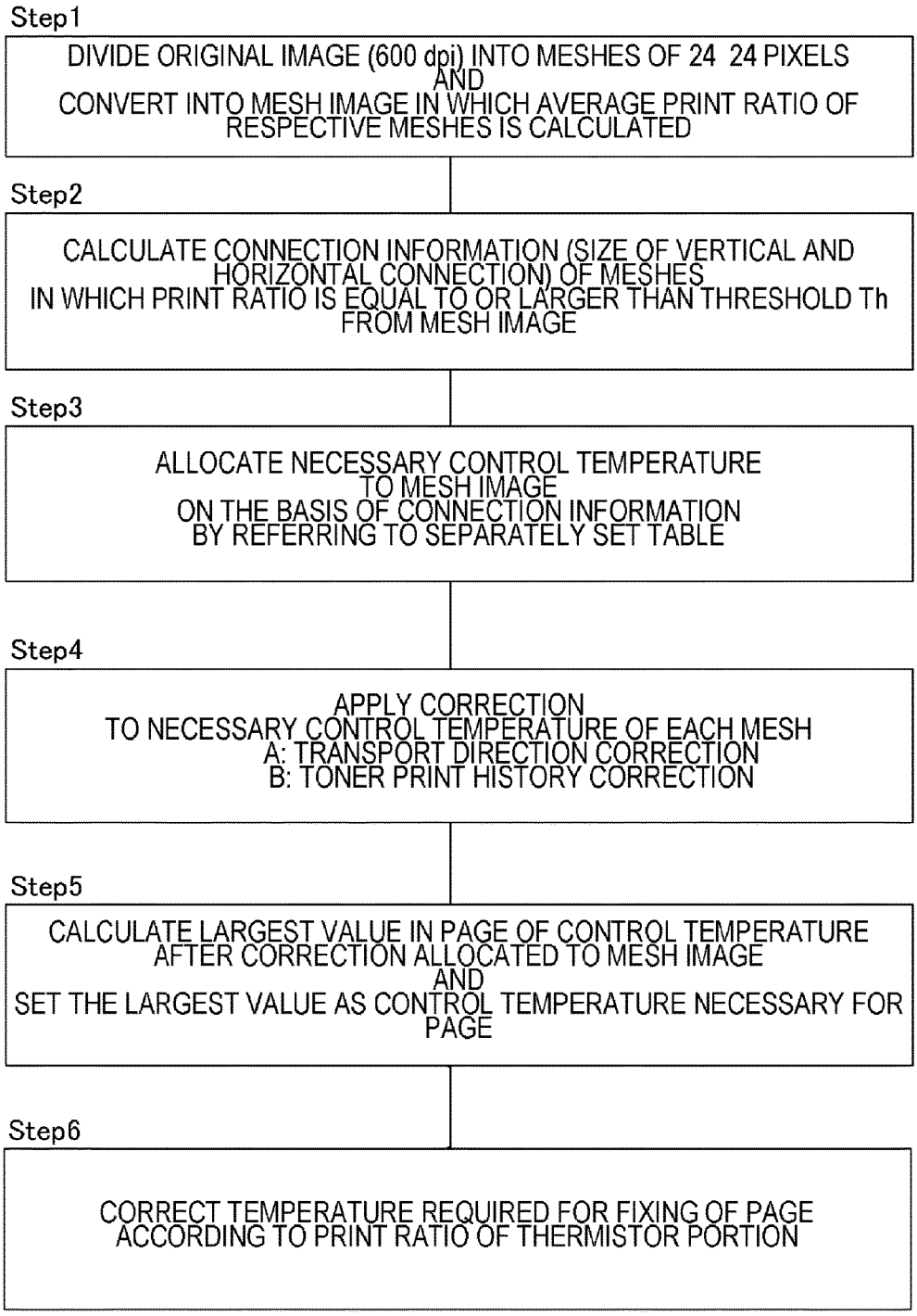
FIG. 13 is a flowchart of calculating a temperature required for fixing according to an invention of Embodiment 3.

The correction method will be described according to the flowchart of a method for calculating a temperature required for fixing illustrated in FIG. 13.

Characteristics of Image Analysis

Steps 1 to 5

Steps 1 to 5 are similar to those of Embodiment 1 and the description thereof will be omitted.

Step 6

Processes until the temperature required for fixing Tp is calculated are similar to those of Embodiment 1.

In the present embodiment, a print ratio is calculated at the position of a rectangle corresponding to a thermistor portion. Specifically, an average print ratio Rtm of meshes M in a range where the rectangle position n is within tm±5 is calculated with respect to a mesh position tm in the longitudinal direction corresponding to the thermistor portion. In the present embodiment, the position number tm of the rectangular mesh M of the thermistor is 25.

$$Rtm = \sum_{m=1}^{m_{max}} \sum_{n=tm-5}^{tm+5} \frac{R(m, n)}{m_{max} \times 11} \qquad \text{Equation 7}$$

$$Tp' = Tp - e \times \frac{Rtm}{100} \qquad \text{Equation 8}$$

Here, e is a coefficient and is 3 in the present embodiment. When the print ratio of a thermistor portion is the largest value (that is, 100%), since a large amount of electric power is supplied, it is possible to fix an image with a temperature that is 3° C. lower than the control temperature. Therefore, the temperature required for fixing Tp is corrected according to the print ratio Rtm of the thermistor portion.

Figure 14A:
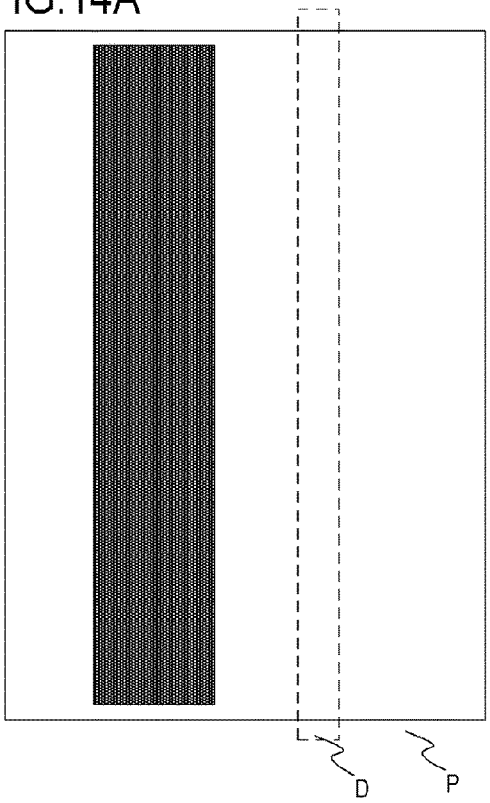
FIGS. 14A and 14B are diagrams for describing images according to an invention of Embodiment 3.
Figure 14B:
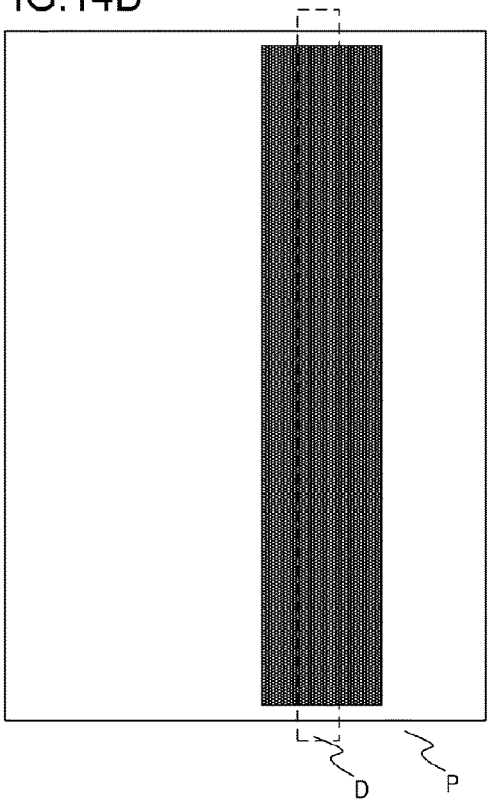

When the calculation process is performed as in the present embodiment, a low control temperature can be set when a vertical stripe of a solid black image is present in the region of the thermistor portion D as in FIG. 14B as compared to a case in which a vertical stripe of a solid black image is present in a region other than the thermistor portion D as in FIG. 14A. Therefore, it may be possible to decrease the control temperature appropriately depending on an image as compared to a case in which the control temperature is increased uniformly in order to secure the fixing performance at positions where the fixing performance is poor. Therefore, it is possible to provide an image forming apparatus having a satisfactory energy saving performance while obtaining a satisfactory fixing performance.

In the present embodiment, although an average value in the entire transport direction of the print ratio Rtm of the thermistor portion D is calculated, there is no limitation thereto. For example, the print ratio may be calculated at respective positions in the transport direction (for example, for respective film cycles), a correction value may be calculated for the respective print ratios, and the temperature required for fixing Tf(m,n) after correction of the respective meshes M(m,n) may be corrected according to the position in the transport direction.

Similar advantages can be obtained when the calculation result of the print ratio of the thermistor portion is transmitted to an engine control portion without correcting the temperature required for fixing so that the engine control portion performs correction and determines the control temperature.

Embodiment 4

In Embodiment 1, the threshold Th is set to 50% in Step 2 and the connection length of the mesh M of which the print ratio is equal to or larger than the threshold is calculated. In Embodiment 4 of the present invention, in order to detect a thin halftone image in addition to Embodiment 1, a second threshold Th2 is set, the connection length of meshes M(m,n) having the print ratio R(m,n) which is equal to or larger than the threshold Th2 and smaller than the threshold Th is calculated, and the temperature required for fixing is calculated. That is, the threshold Th is set as a first threshold, the size of connection in which meshes having the print ratio which is equal to or larger than the threshold Th2 and smaller than the threshold Th are continuously adjacent to each other as second meshes having the print ratio which is equal to or larger than the second threshold and smaller than the first threshold is acquired and is used for setting the temperature required for fixing. In this way, it is possible to set the control temperature appropriately for a thin halftone image. A basic configuration of the image forming apparatus of Embodiment 4 and the image analysis process are similar to those of Embodiment 1 and the description thereof will be omitted.

Characteristics of Image Analysis

Figure 15:
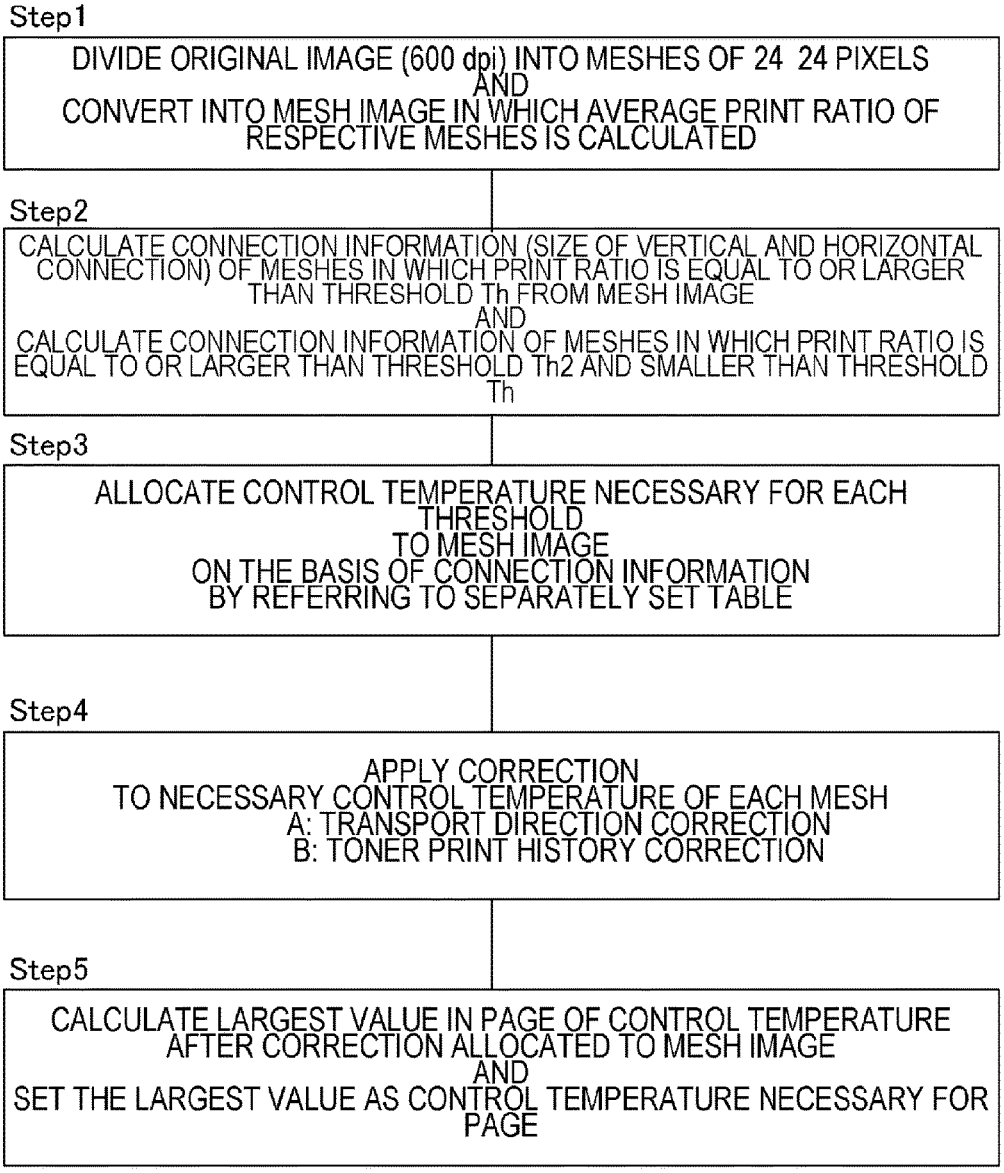
FIG. 15 is a flowchart of calculating a temperature required for fixing according to an invention of Embodiment 4.

A FIG. 15 and FIGS. 16A to 16F illustrate a method of calculating the temperature required for fixing in the image analysis portion 401. FIG. 15 is a processing flowchart when calculating the temperature required for fixing using the calculation method. FIGS. 16A to 16F are schematic diagrams illustrating the content of the processes illustrated in the flowchart of FIG. 15. In FIGS. 16A to 16F, a halftone pattern is disposed.

The respective steps of the flowchart of the method for calculating a temperature required for fixing illustrated in FIG. 15 will be described in detail.

Step 1

Figures 16A, 16B, 16C, 16D, 16E, 16F:
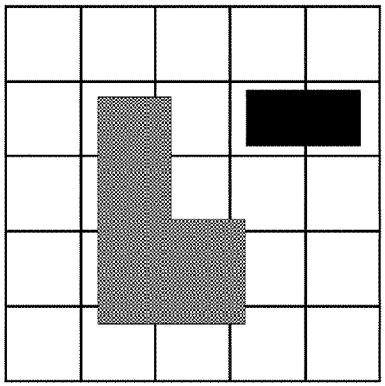
FIGS. 16A to 16F are schematic diagrams illustrating the process of calculating a temperature required for fixing according to an invention of Embodiment 4.

An original image (600 dpi) as illustrated in FIG. 16A is divided into meshes M made up of 24 by 24 pixels and is converted to a mesh image in which the average print ratio of each mesh M is calculated as illustrated in FIG. 16B. In FIG. 16A, a halftone image is included unlike FIG. 6A. The details are similar to those of Embodiment 1 and the description thereof will be omitted.

Step 2

The connection information (vertical and horizontal connection lengths) of meshes M having a print ratio R(m,n) of 50% or more as the threshold Th is calculated from the mesh image. Moreover, the second threshold Th2 is set to 10%, and the connection length of the meshes M having the print ratio which is equal to or larger than the threshold Th2 and smaller than the threshold Th is calculated.

A vertical connection length and a horizontal connection length are client device for meshes M having the print ratio satisfying the thresholds from the mesh image illustrated in FIG. 16B. In this calculation, the vertical connection length and the horizontal connection length are calculated for an image which is three-valued in such a way that 1 is allocated to meshes M having the print ratio equal to or larger than the threshold Th, and 0.5 is allocated to meshes M having the print ratio equal to or larger than the threshold Th2 and smaller than the threshold Th as illustrated in FIG. 16C.

Each of the three-valued meshes M is defined as E2(m,n).

$$E2(m,n)=1 \text{ (if } R(m,n)\geq Th)$$

$$0.5 \text{ (if } Th2\leq R(m,n)<Th)$$

$$0 \text{ (if } R(m,n)<Th2) \qquad \text{Equation 9}$$

The vertical connection length Lv(m,n) and the horizontal connection length Lh(m,n) are calculated according to a method similar to that of Embodiment 1. FIG. 16D illustrates a calculation result of the vertical connection length Lv(m,n) for the three-valued mesh image illustrated in FIG. 16C. FIG. 16E illustrates a calculation result of the horizontal connection length Lh(m,n) for the three-valued mesh image illustrated in FIG. 16C. In the present embodiment, although the meshes M having the value of 1 and the meshes M having the value of 0.5 are adjacent as illustrated in FIG. 16C, the meshes are not determined to be connected but the connection lengths of the meshes are calculated.

Step 3

The necessary control temperature is allocated to each mesh image on the basis of the connection information calculated in Step 2 and by referring to a separately set table. In Step 2, vertical and horizontal connection size information is calculated for each mesh M(m,n). On the basis of the calculation result, in Step 3, by referring to a control temperature setting table set separately as illustrated in Tables 1 and 5, a value obtained by referring to the vertical connection length Lh(m,n), the horizontal connection length Lv(m,n), and the tables is set to each mesh M(m,n). For the three-valued meshes M in FIG. 16C, values obtained by referring to the control temperature setting table for high print ratio in Table 1 are set to the meshes M having the value of 1 and values obtained by referring to the control temperature setting table for low print ratio in Table 5 are set to the meshes M having the value of 0.5.

For example, when the vertical connection length is 1 and the horizontal connection length is 2, temperature $T_{1_2}$ is allocated to the mesh M in which the value of 1 is filled in FIG. 16C by referring to Table 1. When the vertical connection length is 3 and the horizontal connection length is 2, temperature $T2_{3_2}$ is allocated to the mesh M in which the value of 0.5 is filled in FIG. 16C by referring to Table 5. Moreover, temperature $T_{0_0}$ is allocated to the mesh M in which the value of 0 is filled in FIG. 16C. This value is the control temperature T2(m,n) necessary for fixing the mesh M at that position.

Basically, the control temperature setting table 2 for low print ratio in Table 5 is set so that a relatively high control temperature is allocated to a mesh M having a large connection length. However, as compared to the control temperature setting table for high print ratio in Table 1, a lower temperature is set in the control temperature setting table for low print ratio in Table 5. However, the control temperature may be set appropriately when it is necessary to increase the control temperature for low print ratio depending on the toner used or the characteristics of the fixing apparatus.

In the control temperature setting table 2 for low print ratio, since the fixing performance does not change greatly for an image having a connection length of 10 mm or more, the same control temperature as that of an image having a connection length of 10 meshes is set for the mesh having a connection length of 10 meshes or more. However, the table may be changed appropriately depending on a fixing configuration or the like.

In the present embodiment, although the control temperature value is set directly in the table, a correction value for a reference control temperature may be used, a value correlated with the necessary control temperature may be used, and a value correlated with the fixing performance may be used.

TABLE 5

Control Temperature Setting Table 2

| | | Lh | | | | | | | | | |
|---|---|---|---|---|---|---|---|---|---|---|---|
| | | 1 | 2 | 3 | 4 | 5 | 6 | 7 | 8 | 9 | ≥10 |
| Lv | 1 | $T2_{1_1}$ | $T2_{1_2}$ | $T2_{1_3}$ | $T2_{1_4}$ | $T2_{1_5}$ | $T2_{1_6}$ | $T2_{1_7}$ | $T2_{1_8}$ | $T2_{1_9}$ | $T2_{1_10}$ |
| | 2 | $T2_{2_1}$ | $T2_{2_2}$ | $T2_{2_3}$ | $T2_{2_4}$ | $T2_{2_5}$ | $T2_{2_6}$ | $T2_{2_7}$ | $T2_{2_8}$ | $T2_{2_9}$ | $T2_{2_10}$ |
| | 3 | $T2_{3_1}$ | $T2_{3_2}$ | $T2_{3_3}$ | $T2_{3_4}$ | $T2_{3_5}$ | $T2_{3_6}$ | $T2_{3_7}$ | $T2_{3_8}$ | $T2_{3_9}$ | $T2_{3_10}$ |
| | 4 | $T2_{4_1}$ | $T2_{4_2}$ | $T2_{4_3}$ | $T2_{4_4}$ | $T2_{4_5}$ | $T2_{4_6}$ | $T2_{4_7}$ | $T2_{4_8}$ | $T2_{4_9}$ | $T2_{4_10}$ |
| | 5 | $T2_{5_1}$ | $T2_{5_2}$ | $T2_{5_3}$ | $T2_{5_4}$ | $T2_{5_5}$ | $T2_{5_6}$ | $T2_{5_7}$ | $T2_{5_8}$ | $T2_{5_9}$ | $T2_{5_10}$ |
| | 6 | $T2_{6_1}$ | $T2_{6_2}$ | $T2_{6_3}$ | $T2_{6_4}$ | $T2_{6_5}$ | $T2_{6_6}$ | $T2_{6_7}$ | $T2_{6_8}$ | $T2_{6_9}$ | $T2_{6_10}$ |
| | 7 | $T2_{7_1}$ | $T2_{7_2}$ | $T2_{7_3}$ | $T2_{7_4}$ | $T2_{7_5}$ | $T2_{7_6}$ | $T2_{7_7}$ | $T2_{7_8}$ | $T2_{7_9}$ | $T2_{7_10}$ |
| | 8 | $T2_{8_1}$ | $T2_{8_2}$ | $T2_{8_3}$ | $T2_{8_4}$ | $T2_{8_5}$ | $T2_{8_6}$ | $T2_{8_7}$ | $T2_{8_8}$ | $T2_{8_9}$ | $T2_{8_10}$ |
| | 9 | $T2_{9_1}$ | $T2_{9_2}$ | $T2_{9_3}$ | $T2_{9_4}$ | $T2_{9_5}$ | $T2_{9_6}$ | $T2_{9_7}$ | $T2_{9_8}$ | $T2_{9_9}$ | $T2_{9_10}$ |
| | ≥10 | $T2_{10_1}$ | $T2_{10_2}$ | $T2_{10_3}$ | $T2_{10_4}$ | $T2_{10_5}$ | $T2_{10_6}$ | $T2_{10_7}$ | $T2_{10_8}$ | $T2_{10_9}$ | $T2_{10_10}$ |

The control temperature setting table 2 used actually in the present embodiment is illustrated as below.

TABLE 6

Control Temperature Setting Table 2 Used in Present Embodiment

| | | Lh | | | | | | | | | |
|---|---|---|---|---|---|---|---|---|---|---|---|
| | | 1 | 2 | 3 | 4 | 5 | 6 | 7 | 8 | 9 | ≥10 |
| Lv | 1 | 180 | 180 | 180 | 183 | 184 | 185 | 185 | 185 | 185 | 185 |
| | 2 | 180 | 182 | 183 | 184 | 185 | 185 | 185 | 185 | 185 | 185 |
| | 3 | 180 | 183 | 184 | 185 | 185 | 185 | 185 | 185 | 185 | 185 |
| | 4 | 180 | 184 | 185 | 185 | 185 | 185 | 185 | 185 | 185 | 185 |
| | 5 | 181 | 185 | 185 | 185 | 185 | 185 | 185 | 185 | 185 | 185 |
| | 6 | 182 | 185 | 185 | 185 | 185 | 185 | 185 | 185 | 185 | 185 |
| | 7 | 183 | 185 | 185 | 185 | 185 | 185 | 185 | 185 | 185 | 185 |
| | 8 | 184 | 185 | 185 | 185 | 185 | 185 | 185 | 185 | 185 | 185 |
| | 9 | 185 | 185 | 185 | 185 | 185 | 185 | 185 | 185 | 185 | 185 |
| | ≥10 | 185 | 185 | 185 | 185 | 185 | 185 | 185 | 185 | 185 | 185 |

Step 4

Correction is applied to the control temperature necessary for fixing the respective meshes M(m,n) allocated in Step 3. In the present embodiment, two corrections including transport direction correction A and toner print history correction B are performed.

A: Transport Direction Correction

Correction similar to that of Embodiment 1 is applied depending on the position in the transport direction.

B: Toner Print History Correction

Similarly to Embodiment 1, correction is applied when an image is printed before the film cycle of each mesh M.

A correction value of a mesh M(m,n) at a certain position (m,n) is calculated. A correction value TB(m,n) is calculated by the following equation.

$$TB2(m, n) = a \times E2(m-57, n) + b \times E2(m-114, n) + c \times E2(m-171, n) + d \times E2(m-228, n) \quad \text{Equation 10}$$

a, b, c, and d are coefficients, and similarly to Embodiment 1, are set such that a=3.0, b=1.5, c=1.0, and d=0.5. This calculation process is not performed when a calculation target is outside the region of a recording material. In Equation 10, the control temperature is corrected by 3° C. for the mesh M in which a mesh M having a high print ratio is present before one rotation of the film, for example. Moreover, the control temperature is corrected by 1.5° C. for the mesh M in which a mesh M having a low print ratio is present before one rotation of the film, for example.

A temperature required for fixing Tf2(m,n) after correction of each mesh M is calculated as below.

$$Tf2(m,n)=T2(m,n)+TA(m,n)+TB2(m,n) \quad \text{Equation 11}$$

Step 5

A largest value of the temperature required for fixing Tf after correction of each mesh M in Step 4 is calculated for the mesh M in one page of a recording material, and the largest value is used as the control temperature Tp necessary for that page.

$$Tp2 = \max_{\substack{1 \le m \le m_{max} \\ n_{min} \le n \le n_{max}}} Tf2(m, n) \quad \text{Equation 12}$$

In the present embodiment, the control temperature is corrected using the temperature required for fixing Tp for the detection image calculated according to the steps to be described later. The fixing temperature control sequence performed by the fixing temperature control portion is similar to that of Embodiment 1, and the description thereof will be omitted.

By performing detection in the above-described manner, in addition to the advantages of Embodiment 1, it is possible to set the temperature required for fixing appropriately for a halftone image having a low print ratio and to control the fixing temperature optimally for an image pattern. In this way, it is possible to provide an image forming apparatus having satisfactory energy saving performance while obtaining a satisfactory fixing performance regardless of an image pattern.

The configurations of the respective embodiments can be combined with each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-019631, filed on Feb. 6, 2018, which is hereby incorporated by reference herein in its entirety.

What is claimed is:

1. An image forming apparatus comprising:

an image heating portion including a heater including a substrate and a heat generating element provided on the substrate, the image heating portion heating an image formed on a recording material on the basis of image data using the heat of the heater;

a temperature detection portion that detects a temperature of a heating region of the recording material heated by the heater;

an energization control portion that controls electric power to be supplied to the heat generating element;

an image divsion portion that divides the image data to division data including a plurality of regions by dividing a predetermined number of picture elements which is a portion of the image data as one of the plurality of regions; and a continuity acquiring portion that analyzes a value related to a print ratio in each of the regions of the division data and acquires a value related to adjacency indicating how many continuous regions in which the value related to the print ratio exceeds a threshold are adjacent to each other; and wherein the energization control portion controls energization of the heat generating element on the basis of the temperature detected by the temperature detection portion and a control target temperature calculated from the value related to the adjacency.

2. The image forming apparatus according to claim 1, wherein the control target temperature is set with respect to each of the plurality of regions on the basis of the value related to the adjacency, and wherein the energization control portion uses a largest value of the control target temperatures set with respect to each of the plurality of regions as a control target temperature for heating the image and controls energization of the heat generating element on the basis of the temperature detected by the temperature detection portion.

3. The image forming apparatus according to claim 1, wherein the control target temperature is set with respect to each of the plurality of regions on the basis of the value related to the adjacency, and wherein in predetermined regions in which the value related to the print ratio exceeds the threshold among the plurality of regions, the control target temperature in the predetermined region that forms the adjacency is set to a temperature higher than the control target temperature in the predetermined region that does not form the adjacency.

4. The image forming apparatus according to claim 1, wherein the control target temperature is set with respect to each of the plurality of regions on the basis of the value related to the adjacency, and wherein when the size of the adjacency is larger, in predetermined regions in which the value related to the print ratio exceeds the threshold among the plurality of regions, the control target temperature in the predetermined region that forms the adjacency is set to more higher.

5. The image forming apparatus according to claim 1, wherein the continuity acquiring portion acquires the size of the adjacency in a transport direction of the recording material and in a direction orthogonal to the transport direction.

6. The image forming apparatus according to claim 1, wherein the control target temperature is set with respect to each of the plurality of regions on the basis of the value related to the adjacency, and wherein the control target temperature set with respect to each of the plurality of regions is corrected depending on a position in a transport direction of the recording material of each of the regions.

7. The image forming apparatus according to claim 6, wherein the correction involves correcting the control target temperature in each of the regions to a higher temperature than that before the correction, and an amount of correction increases as the region is located closer to an upstream side in the transport direction.

8. The image forming apparatus according to claim 1, wherein the control target temperature is set with respect to each of the plurality of regions on the basis of the value related to the adjacency, and wherein among the plurality of regions, the control target temperature set in a region positioned in a predetermined range from both ends in a direction orthogonal to a transport direction of the recording material is corrected to a higher temperature than that before the correction.

9. The image forming apparatus according to claim 1, wherein the energization control portion is configured to:

(i) divide the plurality of regions into a plurality of groups in a transport direction of the recording material;

(ii) in the respective groups, set a largest value among the control target temperatures set with respect to each of the regions included in the group as a control target temperature for heating regions of the image corresponding to the group; and (iii) control energization of the heat generating element on the basis of the temperature detected by the temperature detection portion.

10. The image forming apparatus according to claim 1, further comprising:

a control temperature setting portion that sets the control target temperature with respect to each of the plurality of regions on the basis of the value related to the adjacency, wherein the temperature detection portion has a temperature detection element disposed in contact with a surface of the heater, wherein the control temperature setting portion is configured to:

(i) acquire an average value of the value related to the print ratio in a region positioned at a position through which the temperature detection element passes among the plurality of regions and a region positioned within a predetermined range from the position in a direction orthogonal to a transport direction of the recording material;

(ii) correct a largest value of the control target temperatures set with respect to each of the regions to a lower temperature than before the correction on the basis of the average value; and (iii) set the corrected temperature as a control target temperature for heating the image and control energization of the heat generating element on the basis of the temperature detected by the temperature detection portion.

11. The image forming apparatus according to claim 1, further comprising:

a control temperature setting portion that sets the control target temperature to each of the plurality of regions on the basis of the value related to the adjacency, wherein the threshold is used as a first threshold, and regions in which the value related to the print ratio exceeds the first threshold among the regions are set as first regions, wherein the continuity acquiring portion acquires the size of adjacency of second regions indicating, among the plurality of regions, how many second regions in which the value related to the print ratio is equal to or larger than a second threshold smaller than the first threshold and is smaller than the first threshold are adjacent to each other, and wherein the control temperature setting portion sets the control target temperature with respect to each of the plurality of regions on the basis of the size of the adjacency of the first regions and the size of the adjacency of the second regions.

12. The image forming apparatus according to claim 1, wherein the image heating portion further includes a cylindrical film that rotates with an inner surface thereof in contact with the heater and the image on the recording material is heated via the film.

13. The image forming apparatus according to claim 12, wherein the control target temperature is set with respect to each of the plurality of regions on the basis of the value related to the adjacency, and wherein among the plurality of regions, the control target temperature set with respect to a region on an upstream side in a transport direction of the recording material which is to be brought into contact with the film subsequently to a region on a downstream side in the transport direction, is corrected to a higher temperature than that before the correction.

14. The image forming apparatus according to claim 1, wherein the print ratio is an average value in one of the regions, of the ratio that the respective picture elements included in the one region include dots serving as an image portion.

15. The image forming apparatus according to claim 1, wherein the print ratio is a median value in one of the regions, of the ratio that the respective picture elements included in the one region include dots serving as an image portion.

16. The image forming apparatus according to claim 1, wherein the print ratio is a mode in one of the regions, of the ratio that the respective picture elements included in the one region include dots serving as an image portion.

* * * * *